US005890774A

United States Patent [19]

Schwartz et al.

[11] Patent Number: 5,890,774

[45] Date of Patent: Apr. 6, 1999

[54] CUSTOMIZABLE FOLIO SYSTEM

[75] Inventors: Douglas G. Schwartz, Montreal; Larry Leibe Mogelonsky, Toronto; Daniel Solomon Schwartz, Dollard des Ormeaux, all of Canada

[73] Assignee: Post-Fax Inc., Montreal, Canada

[21] Appl. No.: 731,397

[22] Filed: Oct. 18, 1996

Related U.S. Application Data

[63] Continuation-in-part of Ser. No. 669,982, Jun. 25, 1996, abandoned.

[51] Int. Cl.[6] ..... B42D 3/08; G09F 1/00

[52] U.S. Cl. ..... 281/31; 40/359; 229/72; 229/800; 283/109

[58] Field of Search ..... 281/31, 35, 44, 281/45, 46; 283/62, 65, 109, 111; 402/73, 80 R, 80 P; 40/359; 229/67.1, 70, 71, 72, 800; 493/450, 947, 948

[56] References Cited

U.S. PATENT DOCUMENTS

| | | | |
|---|---|---|---|
| 868,758 | 10/1907 | Bexell | 229/67.1 |
| 1,065,414 | 6/1913 | Wiesner | 229/67.1 |
| 3,255,869 | 6/1966 | Keller | 229/71 X |
| 4,301,962 | 11/1981 | Monckton et al. | 229/72 |
| 4,431,214 | 2/1984 | Buffington | 283/65 |
| 4,580,814 | 4/1986 | Berler | 283/67 |
| 4,636,179 | 1/1987 | Gentile et al. | 402/79 |
| 4,640,413 | 2/1987 | Kaplan et al. | 206/232 |
| 4,863,093 | 9/1989 | DuCorday | 229/1.5 R |
| 4,934,584 | 6/1990 | Wyant | 229/1.5 R |
| 4,991,767 | 2/1991 | Wyant | 229/1.5 R |
| 5,025,978 | 6/1991 | Pacione | 40/359 X |
| 5,090,732 | 2/1992 | Kuhns | 281/29 |
| 5,141,253 | 8/1992 | Rice | 283/65 |
| 5,330,281 | 7/1994 | Kalan | 281/31 X |
| 5,349,769 | 9/1994 | Okola | 281/31 X |
| 5,405,473 | 4/1995 | Kuhns | 156/226 |
| 5,445,417 | 8/1995 | Bromer et al. | 281/46 |
| 5,447,333 | 9/1995 | Kuhns et al. | 281/29 |
| 5,533,810 | 7/1996 | Jensen | 229/71 X |

*Primary Examiner*—Paul A. Bell
*Attorney, Agent, or Firm*—Virginia H. Meyer, Esq.

[57] ABSTRACT

The present invention provides a new customizable folio system that is useful for presenting selectable optical characteristics to one face of a folio cover. The selectable optical characteristics are presented at one face of the folio cover as the result of selective replacement of insert sheet(s) that are placed into a pocket formed between the outer folio cover sheet and an inner backing sheet. Either the outer front face of the folio cover, or the inner backing sheet has at least one cutout section(s) therein, of any desired shape or design, through which selective part(s) of the insert sheet(s) can be viewed. The insert sheet(s) have optical characteristic(s) that are different from those of either the outer front face of the folio cover or the inner backing sheet, at least in those areas of the insert sheet that can be seen through the cutout section(s). The different optical characteristics may include color and/or texture, as well as printing and/or designs that are added to the insert sheet(s) by the folio user, using any suitable imaging method. The different optical characteristics may further include textual, pictorial, and/or graphic material attached to the insert sheet(s) by the folio user.

57 Claims, 12 Drawing Sheets

CUSTOMIZABLE FOLIO SYSTEM

RELATED APPLICATION

This application is a continuation-in-part of U.S. Ser. No. 08/669,982, filed Jun. 25, 1996 now abandoned.

BACKGROUND OF THE INVENTION

1. Field of the Invention

The present invention relates to a folio system. More particularly, the present invention relates to a new customizable folio system for presenting selected optical characteristics to one face of a folio cover.

2. Description of the Prior Art

The use of folios of different designs and configurations is known in the prior art. Such designs include:

U.S. Pat. No. 4,991,767 to Wyant that discloses a portfolio with photograph displaying cover.

U.S. Pat. No. 5,104,250 to Pacione that discloses a two-piece folder.

U.S. Pat. No. 4,597,590 to Papouchis that discloses a protective wrapper for printed material.

U.S. Pat. No. 4,301,962 to Monckton et al. that discloses a straight line glued folder.

U.S. Pat. No. 4,863,093 to DuCorday that discloses a decorative portfolio-presentation folder that can be partially constructed by the user.

U.S. Pat. No. 868,758 to Bexell that discloses a transparent faced filing card.

U.S. Pat. No. 4,640,413 to Kaplan et al. that discloses a universal package for prerecorded computer disk and associated instructional material.

U.S. Pat. No. 5,405,473 to Kuhns that discloses a method of laminating a customized presentation folder.

U.S. Pat. No. 5,445,417 to Bromer et al. that discloses a presentation folder and method of making.

U.S. Pat. No. 4,934,584 to Wyant that discloses a portfolio with mirrorized cover.

While these devices fulfill their respective objectives and requirements, these prior patents do not describe or suggest a customizable folio system for presenting selected optical characteristics to one face of a folio cover through selective replacement of insert sheet(s), which are inserted into a pocket between outer and inner faces of the folio cover for viewing in selected part through cutout section(s) in either the inner or outer face of the folio cover. In this respect, the customizable folio system according to the present invention substantially departs from the conventional concepts and designs of the prior art, and in doing so provides a folio primarily developed for the purpose of presenting selected optical characteristics to one face of a folio cover through selective replacement of insert sheet(s). Therefore, it can be appreciated a need exists for a new customizable folio system that can be used for presenting selected optical characteristics to one face of a folio cover through selective replacement of insert sheet(s). In this regard, the present invention substantially fulfills this need.

SUMMARY OF THE INVENTION

The present invention provides a new folio system that can be used for presenting customizable optical characteristics to one face of a folio or report cover. According to the invention, the customizable optical characteristics can be presented at either the outer face of a folio cover, or the inner face, which is sometimes referred to herein as the folio cover backing sheet, or the inner backing sheet. In most instances, the customizable optical characteristics are presented at the outer front face of a folio cover as the result of selective replacement of insert sheet(s) that are placed into a pocket formed between the outer cover sheet of a folio cover and an inner backing sheet. The folio cover is formed of any suitable pliable material, such as paper, paperboard, cardboard, fiberboard, composition board, plastic, fabric, leather, or the like. According to the teaching of the invention, there is at least one cutout section(s), of any desired shape or design, in either the outer front face of the folio cover, or an inner backing sheet, through which selective part(s) of the insert sheet(s) can be viewed. The insert sheet(s) have selectable optical characteristic(s) that are different from those of the outer front face of the folio cover, or the inner backing sheet, at least in those areas of the insert sheet(s) that can be seen through the cutout section(s). The selectable and customizable optical characteristics may include color and/or texture. They may also include printing and/or designs that are added to the insert sheet(s) by the folio user, using any suitable imaging method. Suitable methods include, but are not limited to, laser or ink jet printers, typewriters, photocopiers, and "by hand". The different optical characteristics may further include textual, pictorial, and/or graphic material, such as business card(s) or photograph(s), attached to the insert sheet by the folio user by any suitable method. Suitable methods include adhesive or slits cut into the insert sheet(s).

Alternatively, in another embodiment, rather than having the cutout section(s) in the front face of the folio cover, the cutout section(s) may be in an inner backing sheet, so that the different optical characteristics are visible when the folio cover is opened.

More specifically, in one preferred form, the present invention is a folio system comprised of a first folio cover, and selected insert sheet(s) for insertion into a pocket that is formed within the first folio cover. The folio system may also include a second folio cover. In this preferred form the first folio cover will be the front folio cover, and the second cover will be the back folio cover. The insert sheet(s) may be supplied with the folio as part of the folio system, or may be supplied by the folio user.

The first folio cover is comprised of an outer cover sheet and at least one inner backing sheet. Either the outer cover sheet or an inner backing sheet will have at least one cutout therein. In this preferred form an inner backing sheet is affixed or otherwise secured to the outer folio cover sheet so as to form one large pocket between the outer folio cover sheet and the inner backing sheet. (In alternate embodiments, there may be more than one pocket between the outer folio cover sheet and inner backing sheet(s).) The inner backing sheet is preferably substantially the same size as the outer cover sheet, but in alternate embodiments may be smaller than the outer cover sheet. In these alternate embodiments, the inner backing sheet will have at least one vertical edge that is at least one half the length of at least one vertical edge of the outer folio cover sheet.

The folio may be square, but preferably is rectangular in shape, with short upper and lower edges, and longer lateral edges. In a first preferred form, the inner backing sheet is secured to the outer folio cover sheet at the lower and side edges, leaving the upper edge as the open edge of the pocket. In a second preferred form, the inner backing sheet is secured to the outer folio cover sheet at the upper, lower and outer side edges, leaving the inner side edge (of the inner backing sheet) as the open edge of the pocket.

In addition to the folio cover(s), the system of the invention includes insert sheet(s) for use with the cover system. The insert sheet(s) is preferably substantially the same shape as a pocket between the folio's inner backing sheet and its outer folio cover sheet, but just slightly smaller in size to facilitate its insertion into the pocket. The insert sheet(s) has at least one optical characteristic that is different from the folio's outer cover sheet or the inner backing sheet(s), in the area(s) corresponding to the cutout section(s) in either the outer cover or an inner backing sheet, when the insert sheet(s) is in place in the pocket within the front folio cover. (As used herein, different optical characteristic(s) mean differences that are visible and perceptible by the human eye.) Such different optical characteristic(s) may include color and/or texture, as well as textual, pictorial, and/or graphic materials printed on, or attached to, the insert sheet(s). When the different optical characteristics are color and/or texture, they are preferably preprinted on the insert sheet(s). Content, graphics, pictures, and the like, are preferably added by the folio user. After the insert sheet(s) is placed in a pocket between the folio's inner backing sheet and the outer cover sheet, the different optical characteristic (s) are visible through the cutout section(s) in the folio cover. For example, if the different optical characteristic(s) include color, the color will be visible through the cutout section(s) in the folio cover. As indicated above, the different optical characteristic(s) can also include content or other "custom" material that is added by the folio user, thereby giving the cover of the folio a "custom" look as designed and dictated by the folio user.

More specifically, and in the form shown in FIGS. 1, 11 and 12, the insert sheet has at least one area of color and/or texture, wherein the area(s) of color and/or texture has no pre-applied indicia thereon except the color and/or texture, and further wherein the area(s) of color and/or texture is approximately co-extensive with the cutout window section (s) and is visible through the cutout window section(s) when the insert sheet is placed in the pocket between the outer cover and inner backing sheet.

Further, in yet another embodiment, the folio cover may include two or more separate pockets into which insert sheet(s), and supplemental material(s), can be placed. By way of example, when there are two separate pockets, the front folio cover is formed separately from the back folio cover, and the two are later bound. The front folio cover comprises a front cover sheet and first and second inner backing sheets. The inner backing sheets are attached to the front folio cover so as to create two separate pockets for the receipt of insert sheet(s), and supplemental material(s), if desired. Additionally, either the front cover sheet, or one or both of the inner backing sheet(s), may have cutout openings positioned in the pocket(s) such that the different visual characteristics of the insert sheet(s) and/or supplemental material(s) may be viewed.

By way of example and according to one teaching of the invention, the outer front cover sheet of the folio may have at least one cutout "window" section that is large enough to accommodate desired content, such as title(s), and/or textual material(s), and/or graphic(s). In addition to the window section(s) there may be additional cutout sections that are smaller in size. These smaller cutout sections create a design, which for example might be arrays of small squares, circles, diamonds, triangles, diagonals or the like. In this configuration, there will be a single insert sheet that will have one optical characteristic, e.g., color and/or texture and/or graphics of a first type, in the area of the window, and another, e.g., color and/or texture and/or graphics of a second type, in the area of the design element cutouts. The folio user can print or add desired content, such as title, text and/or graphics, on the insert sheet in the area that will be visible through the window in the front cover, for example, by means of laser or ink jet printers, typewriters, photocopiers, or by hand. The insert sheet may also have a second optical characteristic, e.g., color and/or texture and/or graphics of a second type, in the area of the design element cutouts. When the insert sheet is placed in the pocket between the outer folio cover sheet and the backing sheet, the first optical characteristic and the printed material added by the folio user will be visible through the window in the folio cover, while the second optical characteristic will be visible through the design cutouts above and/or below the rectangular cutout section. As a result, and in this example, the folio cover will have a custom look, and three tones: the tone of the cover, the tone of the material that is visible through the cutout window, and the tone of the design cutouts. This custom, multiple tone effect is achieved easily and inexpensively with the folio, the pre-colored insert sheet, and custom material added by the folio user, using any suitable means.

The more important features of the invention have thus been outlined, rather broadly, so that the detailed description thereof that follows may be better understood, and in order that the present contribution to the art may be better appreciated. Additional features of the invention will be described below.

In this respect, before explaining preferred embodiments of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

OBJECTS OF THE INVENTION

It is an object of the present invention to provide a new folio cover system for presenting selected optical characteristics to one face of a folio cover through selective replacement of insert sheet(s).

Another object of the present invention is to provide a new folio cover system for presenting different optical characteristics to one face of a folio cover, which can easily be customized by the folio user.

Another object of the present invention is to provide a new folio cover system for presenting different optical characteristics, including textual, pictorial, and/or graphic materials, to one face of a folio cover through selective replacement of insert sheet(s).

Another object of the present invention is to provide a new folio cover system for presenting different optical to one face of a folio cover through selective replacement of insert sheet(s) to which supplemental material(s) have been attached.

It is another object of the present invention to provide a new folio cover system that may be easily and efficiently manufactured and marketed.

It is a further object of the present invention to provide a new folio cover system that is of durable and reliable construction.

An even further object of the present invention is to provide a new folio cover system that is susceptible of a low cost of manufacture with regard to both materials and labor, and which accordingly is then susceptible of low prices of sale to the consuming public, thereby making such a folio cover system economically available to the buying public.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9A is a plan view of the back cover of a second preferred embodiment of the present invention shown in a spread orientation.

FIG. 12A is a front view of the insert sheet of a third preferred embodiment.

FIG. 16A is a front view of an insert sheet of the fourth preferred embodiment.

FIG. 17A is a plan view of a fifth preferred embodiment in spread orientation.

FIG. 19A is a plan view of a seventh preferred embodiment in spread orientation.

FIG. 20A is a plan view of a double-pocket folio cover of an eighth preferred embodiment in spread orientation.

FIG. 21A is a plan view of a folio cover of a ninth preferred embodiment in spread orientation.

The same reference numerals refer to the same parts throughout the various Figures.

DESCRIPTION OF A FIRST PREFERRED EMBODIMENT

With reference now to the drawings, and in particular, to FIGS. 1–8 thereof, a first preferred embodiment of the new folio cover system embodying the principles and concepts of the present invention and generally designated by the reference number 10 will be described.

Specifically, it will be noted in the various Figures that the invention relates to a customizable folio system for presenting different optical characteristics to one face of a folio cover through selective replacement of insert sheet(s). In its broadest context, the invention consists of an outer folio cover sheet affixed to a folio cover backing sheet, wherein either the folio front cover sheet or the inner backing sheet has at least one cutout section therein, and at least one insert sheet. The insert sheet(s) can be provided with the folio cover/backing sheet combination, or can be provided separately.

Figure 1:
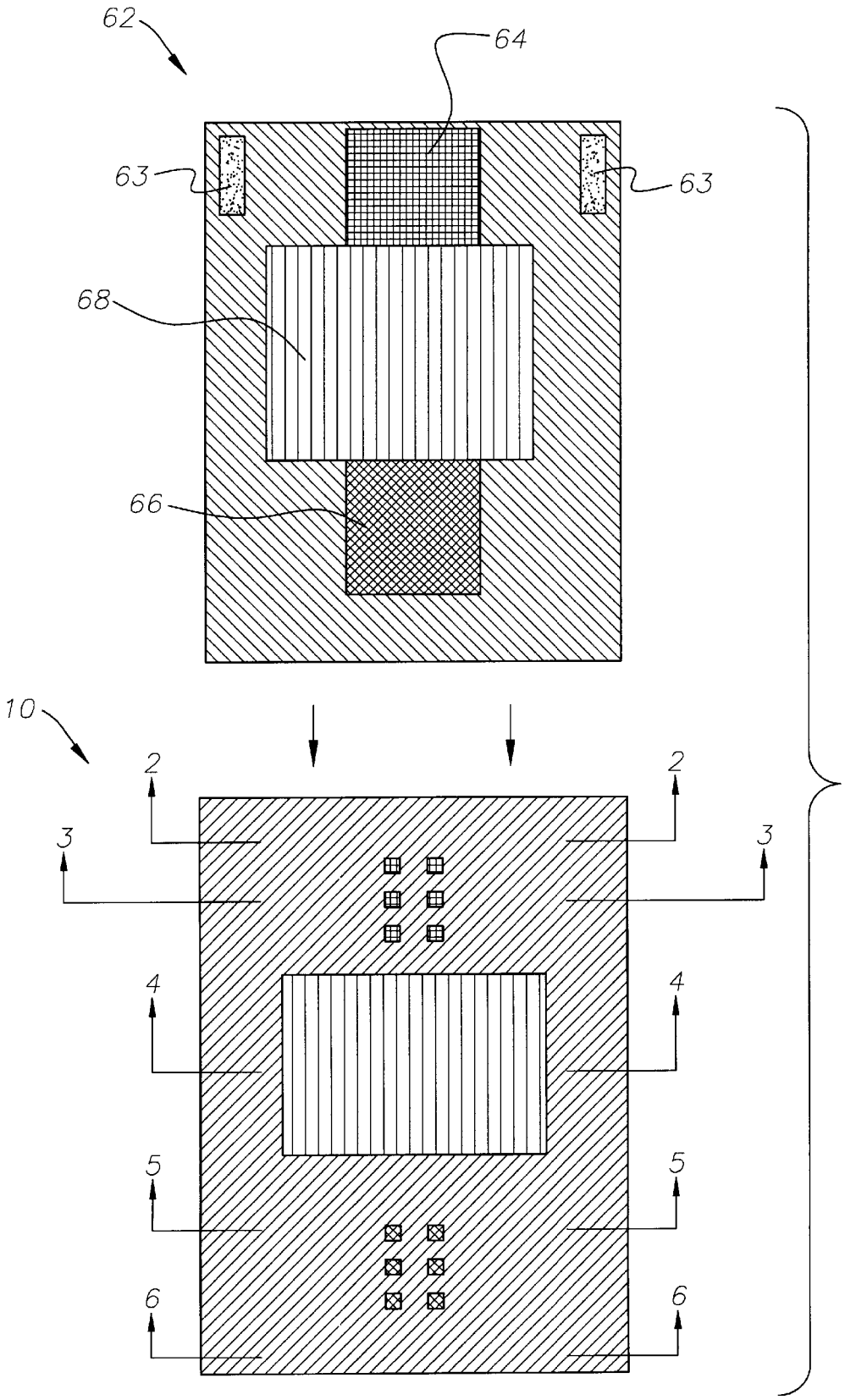
FIG. 1 is a front view of a first preferred embodiment of the folio system constructed in accordance with the principles of the present invention.
Figure 8:
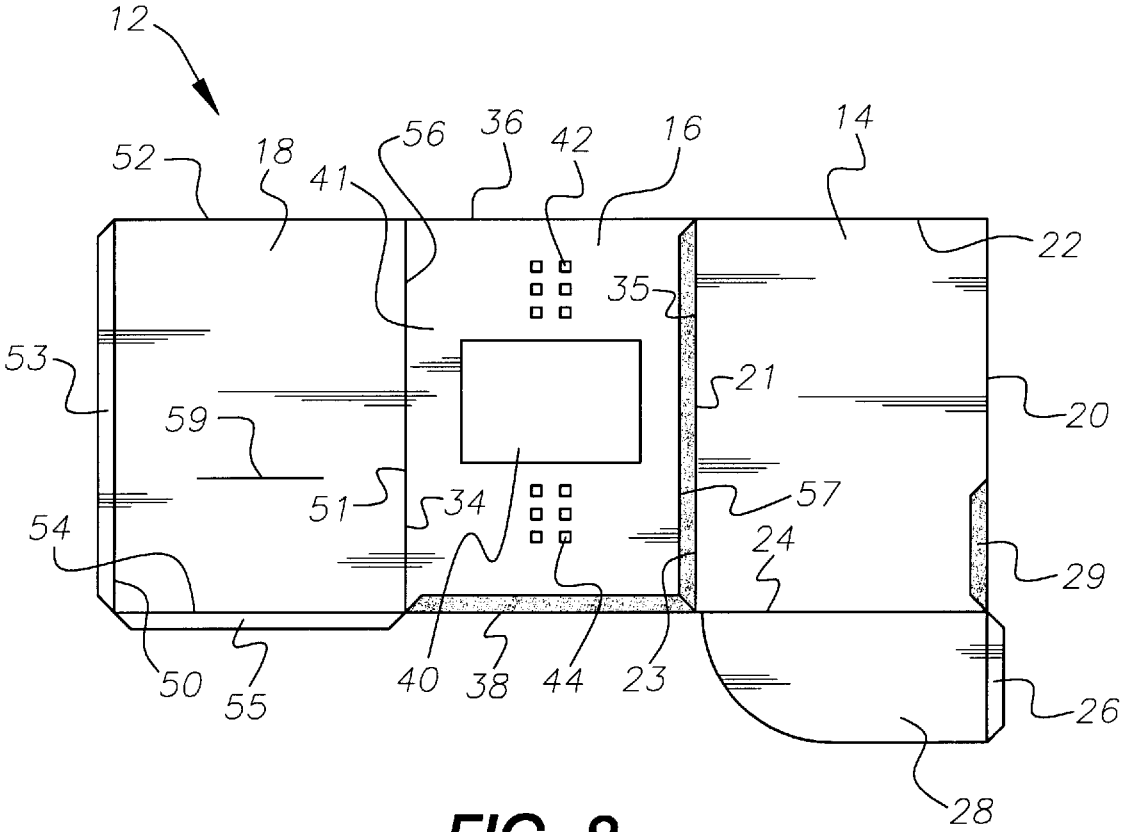
FIG. 8 is a plan view of a first preferred embodiment of the present invention shown in a spread orientation.

More specifically, in a first preferred embodiment the present invention is a system 10, as shown in FIG. 1. System 10 has a folio 12, as shown in FIG. 8. The folio is preferably rectangular in configuration, and in the first preferred embodiment is formed of a first rear or back cover sheet 14, a second outer front cover sheet 16 and a third front cover backing sheet 18. Back cover sheet 14 has long vertical side edges 20 and 21. In this preferred form it also has a short upper edge 22 and a short lower edge 24. Back cover sheet 14 may have a short bottom flap 28 that extends downwardly from bottom edge 24. Short bottom flap 28 may have one short laterally disposed flap 26. Short bottom flap 28 is adapted to be folded upwardly to cover a portion of the back cover sheet. Short lateral flap 26 is adapted to be folded under. Preferably there is adhesive 29 that couples together short lateral flap 26 and back cover sheet 14 to form a pouch pocket 30 in back cover sheet 14 for the receipt of supplemental materials. Alternatively, but not shown, the pouch pocket may be formed of a lateral flap adapted to be folded inwardly so as to be in contact with the inner face of the back cover sheet.

Next provided in system 10 of this embodiment is the folio's second sheet, namely outer front cover sheet 16. Outer front cover sheet 16 is also preferably in a rectangular configuration. Outer front cover sheet 16 has two long vertical side edges, 34 and 35. Outer front cover sheet 16 may be formed separately from back cover sheet 14, but in a preferred style is formed integrally with it. Specifically, vertical long edge 35 of outer front cover sheet 16 is formed integrally with long vertical edge 21 of back cover sheet 14 of the folio, along a first common joining or vertical fold line 23. Outer front cover sheet 16 further has a short upper edge 36 and a short lower edge 38. Outer front cover sheet 16 has at least one cutout opening therein, which in this embodiment is shown as a large rectangular window opening 40. Such an opening is preferably located in the central extent 41 of outer front cover sheet 16. Outer front cover sheet 16 still further preferably has an array of small cutout design openings 42 above the large window opening 40. There also may be an array of small cutout design openings 44 beneath large window opening 40.

Figure 2:
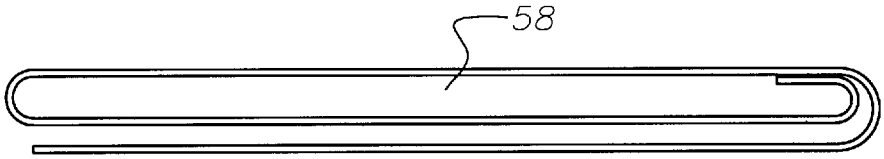
FIG. 2 is a cross-sectional view as taken along line 2—2 of FIG. 1.
Figure 3:
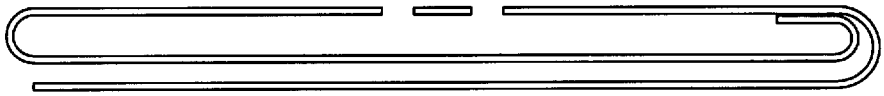
FIG. 3 is a cross-sectional view as taken along line 3—3 of FIG. 1.
Figure 4:
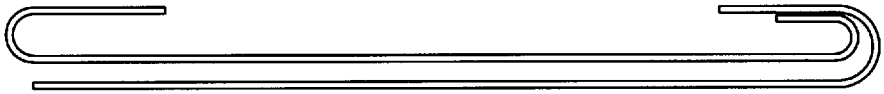
FIG. 4 is a cross-sectional view as taken along line 4—4 of FIG. 1.
Figure 5:
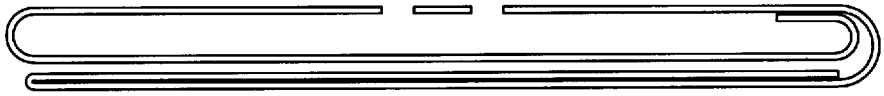
FIG. 5 is a cross-sectional view as taken along line 5—5 of FIG. 1.
Figure 6:
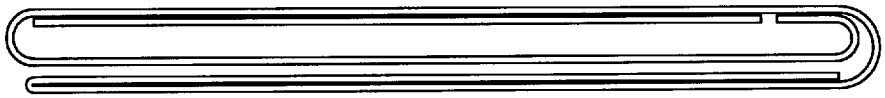
FIG. 6 is a cross-sectional view as taken along line 6—6 of FIG. 1.
Figure 7:
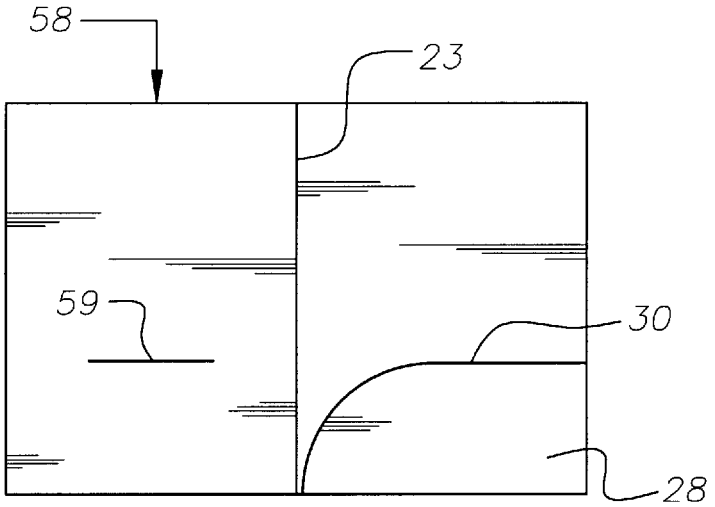
FIG. 7 is a plan view of a first preferred embodiment of the present invention in an open orientation.

Next provided in this embodiment is the third folio sheet, namely the inner front cover backing sheet 18. Inner front cover backing sheet 18 is also preferably in a rectangular configuration. Inner front cover backing sheet may be formed separately from outer front cover 16, but in a preferred style, is formed integrally with it. Inner front cover backing sheet 18 has long side edges 50 and 51. It also has a short upper edge 52 and a short lower edge 54. Long edge 51 of inner front cover backing sheet 18 is preferably formed integrally with long vertical edge 34 of outer front cover sheet 16 at a second common joining or vertical fold line 56. Inner front cover backing sheet may have a lateral flap 53 extending along vertical edge 50, and a bottom flap 55 extending downwardly from bottom edge 54. In this embodiment, lateral flap 53 is folded in, bottom flap 55 is folded up, and inner front backing sheet 18 is folded over and made to be in contact with outer front cover sheet 16. Preferably, adhesive 57 couples lateral flap 53 and bottom flap 55 to front cover sheet 16 to thereby form a pocket 58 with an open upper edge between the outer front cover sheet and the front cover backing sheet. Pocket 58 is shown in FIG. 2.

Front cover backing sheet 18, or short bottom flap 28 may have means for securing a business card or other material thereto. In FIG. 8 the securing means are shown as slit 59, into which a brochure or other material(s) can be placed. Alternatively, but not shown, the securing means may be slits in short bottom flap 28 into which the corners or edges of a business card are placed. Still further, and also not shown, the securing means may be a pouch pocket in front cover backing sheet 18 into which brochures or other material(s) are placed.

Lastly provided in system 10 is an insert sheet 62. Such insert sheet is positionable within pocket 58. The insert sheet may be provided with the folio, or may be provided separately. As shown in FIG. 1, insert sheet 62 preferably has an upper region 64 of a first optical characteristic positionable behind cutout design openings 42 above large window opening 40. It further preferably has a lower region 66 of an optical characteristic positionable behind cutout design openings 44 beneath large window opening 40. Insert sheet 62 still further preferably has a central region 68 of another optical characteristic that may be different from upper and lower regions 64, 66 for being viewed through large window opening 40. The selectable optical characteristics of insert 62 allow folio 12 to take on different visual looks. The preferable fabrication of insert 62 is a sheet of laser printable paper with preprinted different color characteristics on opposing sides of the sheet. After selecting one of the preprinted colors, additional selectable optical characteristics can be added to insert 62, including, but not limited to, additional color, texture, printing, graphics, photographs and/or business cards. Insert 62 is then placed within pocket 58 between outer front cover sheet 16 and front cover backing sheet 18 with the selected optical characteristics aligned with the opening(s) in outer front cover sheet 16 to allow the optical characteristics to be viewed in conjunction with an alternate color of overall folio 12. If desired, insert 62 may include adhesive means 63, for example in the area of the upper corners, for securing insert sheet 62 to the inner face of front cover 16.

DESCRIPTION OF A SECOND PREFERRED EMBODIMENT

Figure 9A:
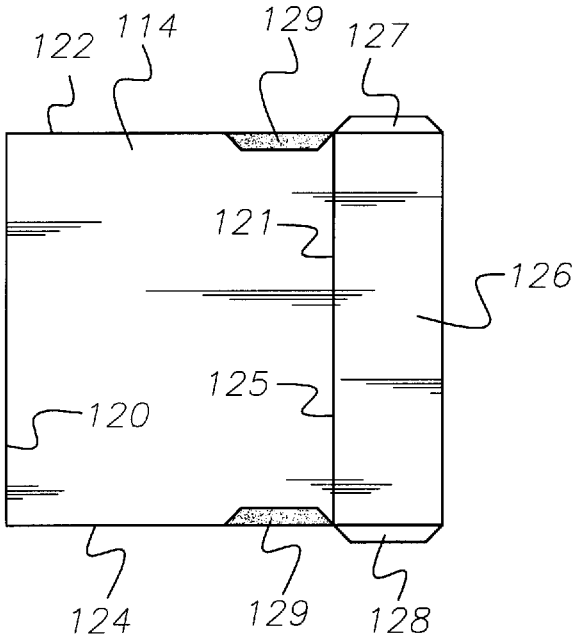
FIGS. 9A and B.
Figure 9B:
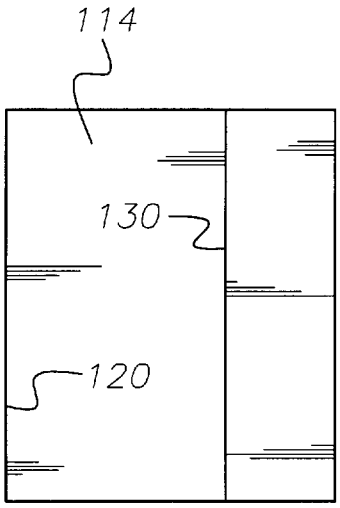
FIG. 9B is a plan view of the back cover, showing the pocket therein.

In the second preferred embodiment the front and back folio covers are formed separately from one another, and are designed to be later bound, or otherwise suitably joined together. This form of the invention is shown in FIGS. 9 and 10.

The system of the invention is again comprised of a folio and insert sheet(s). The folio of this second embodiment is also preferably rectangular in configuration, and as shown in FIG. 9A, is formed in part of a first rear or back cover sheet 114. As shown in FIG. 10, the folio of this embodiment is also formed of a separate second outer front cover sheet 116 and a third front cover backing sheet 118. Back cover sheet 114 has long vertical side edges 120 and 121. In preferred form back cover sheet has a short upper edge 122 and a short lower edge 124. Back cover sheet 114 may also have one laterally disposed flap 126 that extends the length of vertical edge 121. Lateral flap 126 may have a short top flap 127 that extends upwardly from the top edge of lateral flap 126, and a short bottom flap 128 that extends downwardly from the bottom edge of lateral flap 126. Bottom flap 128 is adapted to be folded upwardly, and top flap 127 is adapted to be folded downwardly. Lateral flap 126 is adapted to be folded inwardly along vertical fold line 125 so as to be in contact with the inner face of back cover sheet 114. Top flap 127 and bottom flap 128 preferably have adhesive 129 that couples short top flap 127 and short bottom flap 128 to the inner face of back cover sheet 114 to form a lateral pouch pocket 130 for the receipt of supplemental sheets of material.

Figure 10:
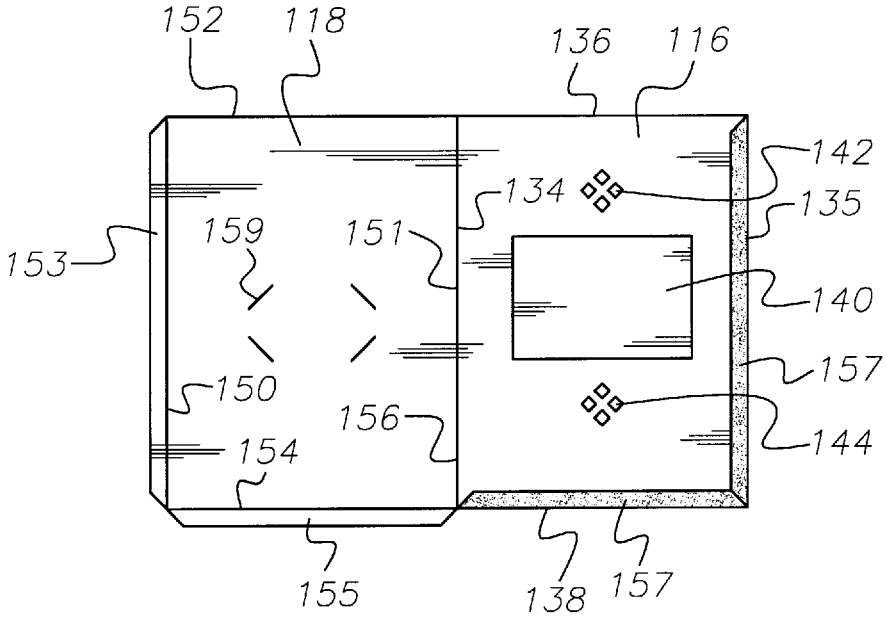
FIG. 10 is a plan view of a second preferred embodiment of the present invention of the front cover shown in spread orientation.

As shown in FIG. 10, next provided in this embodiment is the folio's separate outer front cover 116. Outer front cover 116 is preferably in a rectangular configuration, having long vertical side edges 134 and 135. It further has a short upper edge 136 and a short lower edge 138. Outer front cover 116 is formed with at least one cutout therein, which in this embodiment is shown as large rectangular window opening 140. Front cover sheet 116 further preferably has an array of small cutout openings 142 and 144 above and below large rectangular window opening 140.

Next provided is inner front cover backing sheet 118, which is also preferably in a rectangular configuration. Inner front cover backing sheet may be formed separately from outer front cover 116, but in a preferred style, is formed integrally with it.

Inner front cover backing sheet 118 has long side edges 150 and 151, a short upper edge 152 and a short lower edge 154. In preferred form, inner front backing sheet has lateral flap 153 that extends laterally along the length of vertical edge 150. In addition there is a bottom flap 155 that extends downwardly from short lower edge 154. Lateral flap 153 is adapted to be folded inwardly and bottom flap 155 is adapted to be folded upwardly. Long edge 151 of the inner front cover backing sheet is preferably formed integrally with long vertical edge 134 of outer front cover sheet 116 to form a joining or vertical fold line 156. When the outer front cover sheet is formed integrally with the inner front backing sheet, the inner front backing sheet 118 is folded over and in contact with outer front cover sheet 116. Preferably adhesive 157 couples lateral flap 153 and bottom flap 155 of front cover backing sheet 118 to front cover sheet 116 to thereby form a pocket with an open upper edge between the outer front cover sheet and the front cover backing sheet.

Front cover backing sheet 118, or lateral flap 126, may have means for securing a business card or other material. In FIG. 10, the securing means are shown as four diagonal slits 159 in front cover backing sheet 118 into which the four corners of the business card are placed. Still further, and also not shown, the securing means may be a pouch pocket in front cover backing sheet into which a business card, a brochure, or other material is placed.

Lastly provided is an insert sheet that is positionable within the pocket. Insert sheet was discussed in the first preferred embodiment, and the discussion of that element will not be repeated here.

In use, the folio may be supplied with insert sheet(s), or the insert sheet(s) can be supplied by the user. In either event, the folio user adds desired content and/or graphic to the insert sheet in the area(s) that will be exposed though cutout(s) in the folio cover or the backing sheet. The insert sheet is then inserted into the pocket between the outer cover sheet, and the folio cover inner backing sheet. For the folio of the first preferred embodiment, desired materials can then be placed in the folio. If the folio of the second preferred embodiment is being used, desired materials are placed between the front and back folio covers, which are then bound or otherwise joined together.

DESCRIPTION OF A THIRD PREFERRED EMBODIMENT

Figure 11:
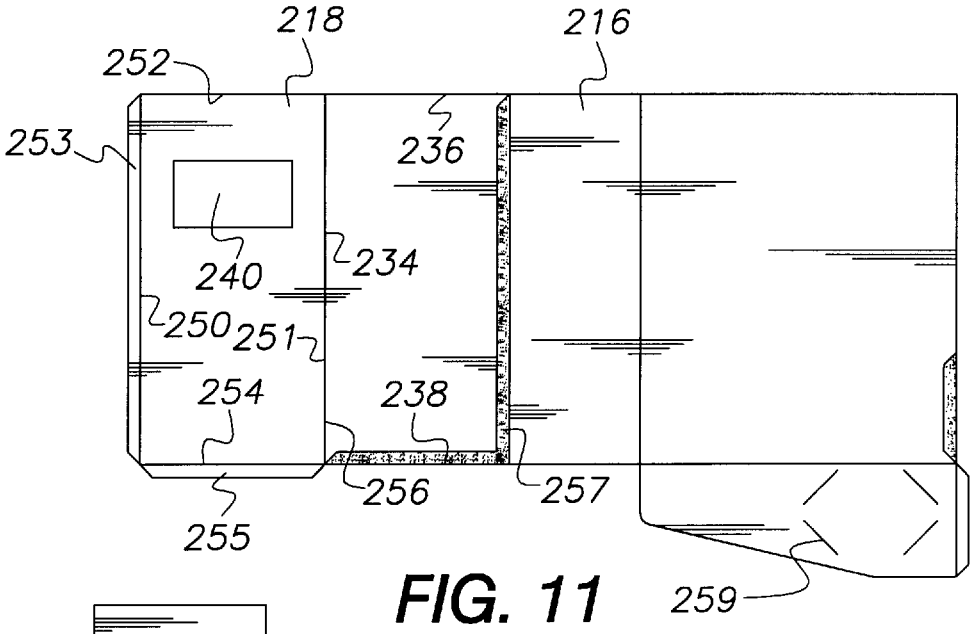
FIG. 11 is a plan view of a third preferred embodiment of the present invention in spread orientation.
Figure 12A:
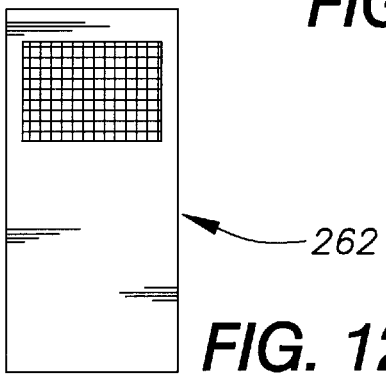
FIGS. 12A and B.
Figure 13:
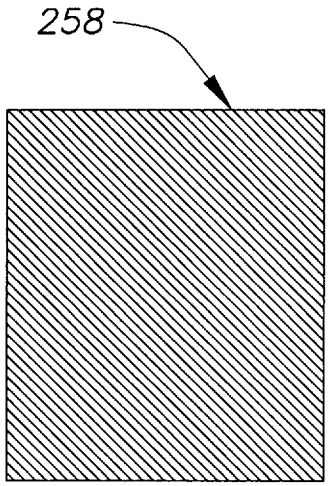
FIG. 13 is a front view of a third preferred embodiment constructed in accordance with the principles of the present invention.
Figure 12B:
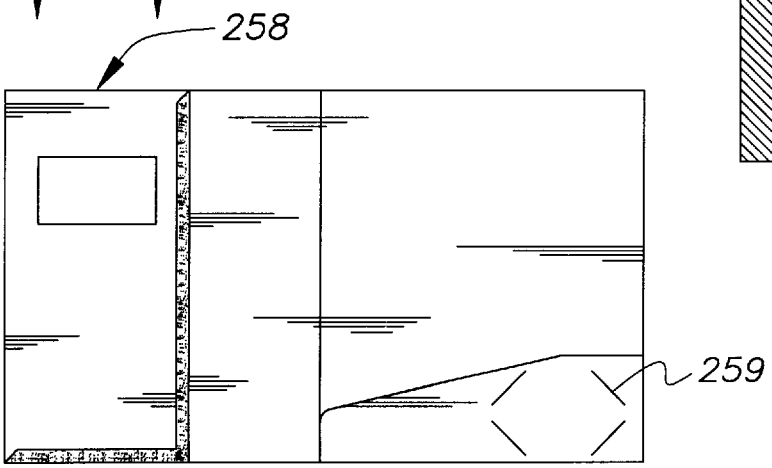
FIG. 12B is a plan view of a third preferred embodiment of the present invention in an open orientation.

In a third preferred embodiment the inner backing sheet 218 is smaller in size, along the upper and lower edges, than outer front cover sheet 216. This form of the invention is shown in FIGS. 11–13. The system of the invention is again comprised of a folio cover and insert sheet(s). The folio of this third embodiment is also preferably rectangular in configuration. As shown in FIG. 11, short upper edge 252 and short lower edge 254 of backing sheet 218 are shorter in length than short upper edge 236 and short lower edge 238 of outer front cover 216. Accordingly, coupling outer front cover sheet 216 and backing sheet 218 results in a smaller pocket for placement of a correspondingly smaller insert sheet. See FIGS. 12B and 13. In this embodiment, the cutout 240 is in the inner backing sheet. Otherwise, the design and assembly of the third preferred embodiment is substantially the same as the first preferred embodiment.

The following is a description of the assembly of the smaller pocket of this embodiment. Inner front cover backing sheet 218 is again preferably rectangular in configuration. Inner front cover backing sheet 218 may be formed separately from outer front cover sheet 216, but in preferred style is formed integrally with it. Inner front cover backing sheet 218 has long side edges 250 and 251. It also has short upper edge 252 and short lower edge 254. In preferred form, front cover backing sheet has a lateral flap 253 which extends laterally along the length of vertical edge 250. Additionally, backing sheet 218 includes short bottom flap 255 which extends downwardly from short lower edge 254. Lateral flap 253 is adapted to be folded inwardly and bottom flap 255 is adapted to be folded upwardly. Long edge 251 of inner front cover backing sheet 218 is formed integrally with long vertical edge 234 of outer front cover sheet 216 to form a common joining or vertical fold line 256. To form the pocket, inner front cover backing sheet 218 is folded over and into contact with the inner face of outer front cover sheet 216. Preferably, adhesive 257 couples lateral flap 253 and bottom flap 255 to outer front cover sheet 216, thereby forming a pocket 258 with an open upper edge between outer front cover sheet 216 and backing sheet 218. Pocket 258 is shown in FIGS. 12B and 13. An insert sheet 262, which is substantially the same size as the pocket between inner front cover backing sheet 218 and outer front cover sheet 216, is then positioned within pocket 258. The insert sheet is visible through cutout(s) in the inner backing sheet.

Further, the pouch pocket has slits 259 into which the four corners of a business card are placed. The remaining components, features and assembly of the third preferred embodiment are identical to the first preferred embodiment. Reference should be had to the description of the first preferred embodiment, as such description will not be repeated here.

DESCRIPTION OF A FOURTH PREFERRED EMBODIMENT

In the fourth preferred embodiment, the insert sheet includes means for attaching textual, pictorial and/or graphic material(s) thereto. More specifically, the system of the fourth preferred embodiment includes a folio and an insert sheet both of which are adapted for the display of material(s) such as business card(s) and/or photograph(s). In use, the user attaches the desired materials, such as business card(s) or photograph(s), etc., to the insert sheet and then positions the insert sheet into the pocket created by the outer front cover sheet and the inner front cover backing sheet. The outer front cover sheet includes cutout opening(s) corresponding to the locations of the attached material(s) and other printed content on the insert sheet such that the attached material(s) are visible through the cutout openings in the folio cover.

As shown in FIGS. 14–16B, the system of this embodiment again includes a folio 312 and an insert sheet 362. The folio of this fourth embodiment is preferably rectangular in configuration, and is formed of a first back cover sheet 314, a second outer front cover sheet 316, and a third front cover backing sheet 318. The components and assembly of this system are identical to that of the first preferred embodiment, except as noted below. Therefore, for common elements, reference should again be made to the description of the first preferred embodiment.

The system 310 provides a folio wherein the user may attach textual, pictorial and/or graphic material(s), such as business card(s) and photograph(s), to the insert sheet for display through cutout openings 341 in the outer front cover sheet 316. To that end, outer front cover sheet 316 has a set of cutout window openings 341. In this embodiment, cutout window openings 341 are shaped appropriately for the display of standard-sized business cards. Outer front cover sheet 316 further may have cutout window opening 340 for the display of text 366 printed on insert sheet 362.

Figure 16A:
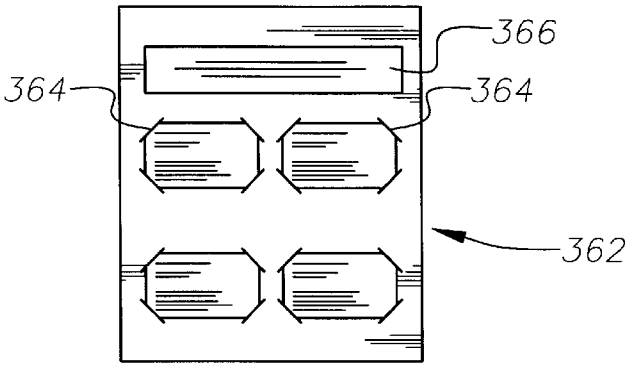
FIGS. 16A and B.
Figure 16B:
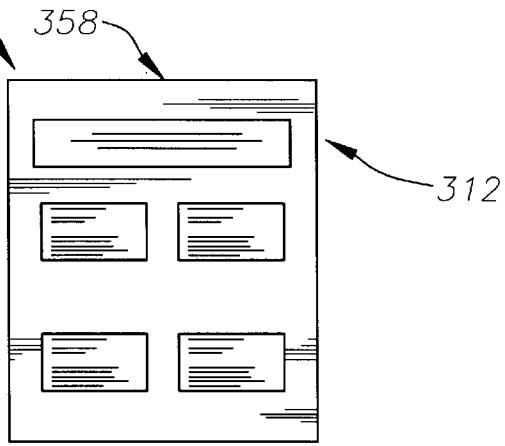
FIG. 16B is a front view of the fourth preferred embodiment of the folio system constructed in accordance with the principles of the present invention.
Figure 14:
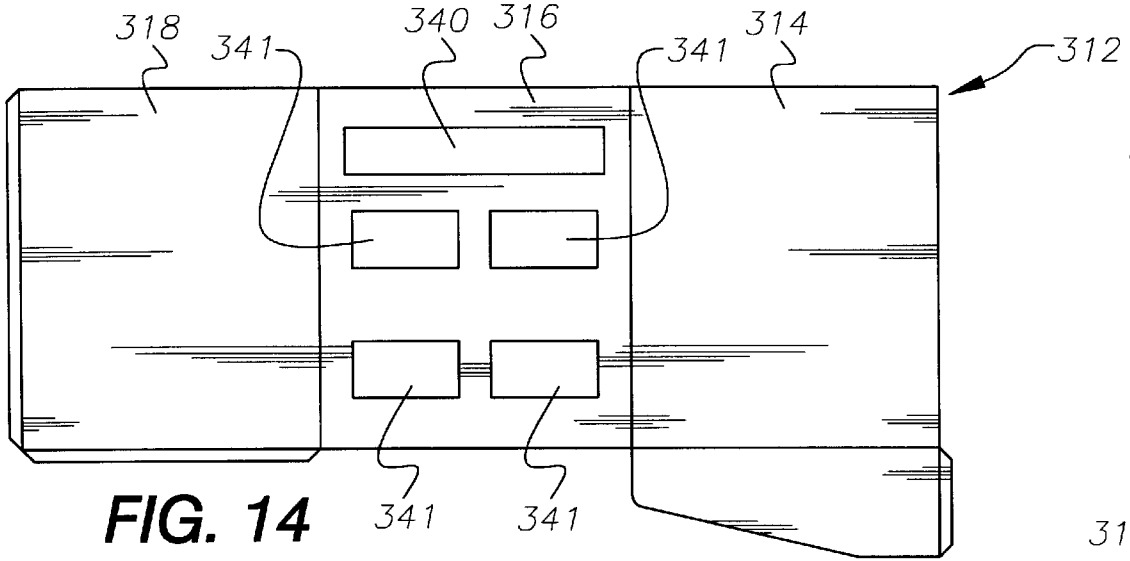
FIG. 14 is a plan view of a fourth preferred embodiment of the present invention in spread orientation.
Figure 15:
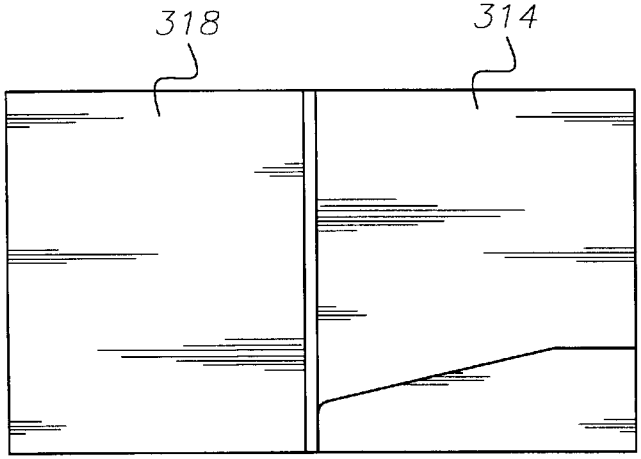
FIG. 15 is a plan view of a fourth preferred embodiment in an open orientation.

Next, provided in this folio system is insert sheet 362. The insert sheet is again positionable within a pocket 358 between outer front cover sheet 316 and inner backing sheet 318. Insert sheet 362, as shown in FIG. 16A, includes text 366, which has been printed on an area on the insert sheet reserved for text. The insert sheet of the fourth preferred embodiment also includes means for securing materials such as business cards thereto. Specifically, in this embodiment, insert sheet 362 includes 4 sets of slits 364 into which the four corners of a business card can be placed. Other means for attaching photographs or business cards include adhesive regions with peel away backing located on the insert sheet. In yet other embodiments, an insert sheet may be provided having printed markings indicating where the user is to secure the desired textual, pictorial and/or graphic material. The user then simply secures the desired materials to the insert sheet with adhesive at the marked locations. Further, insert sheet 362 may include adhesive means (not shown), in the area of the upper corners, for securing insert 362 to the inner face of front cover 316. Insert sheet 362 may also include a transparent cover sheet (not shown) that is placed in front of the insert sheet, or is attached thereto.

In use, the user prints any desired content on the insert sheet and/or secures any desired textual, pictorial, and/or graphic materials to insert sheet 362. If a cover sheet is included, the user places it over the insert sheet to cover the secured materials. Next, the user places insert sheet 362 into pocket 358. The locations of slits 364 on insert sheet 362 are such that the secured materials are visible through the cutout window openings 341 in outer front cover sheet 316. Similarly, the printed text 366 is visible through cutout window opening 340 of the outer front cover sheet.

The remaining components, features and assembly of the fourth preferred embodiment are identical to the first embodiment, which was discussed above and will not be repeated here.

DESCRIPTION OF A FIFTH PREFERRED EMBODIMENT

In a fifth preferred embodiment, the front cover backing sheet attaches to the upper and lower edges and a lateral edge of the front cover sheet to define a pocket with an opening at a lateral edge of the front cover. Otherwise, the construction and assembly of the fifth preferred embodiment are substantially the same as previous embodiments. Accordingly, only the assembly of the different features of this embodiment is described.

Figure 17A:
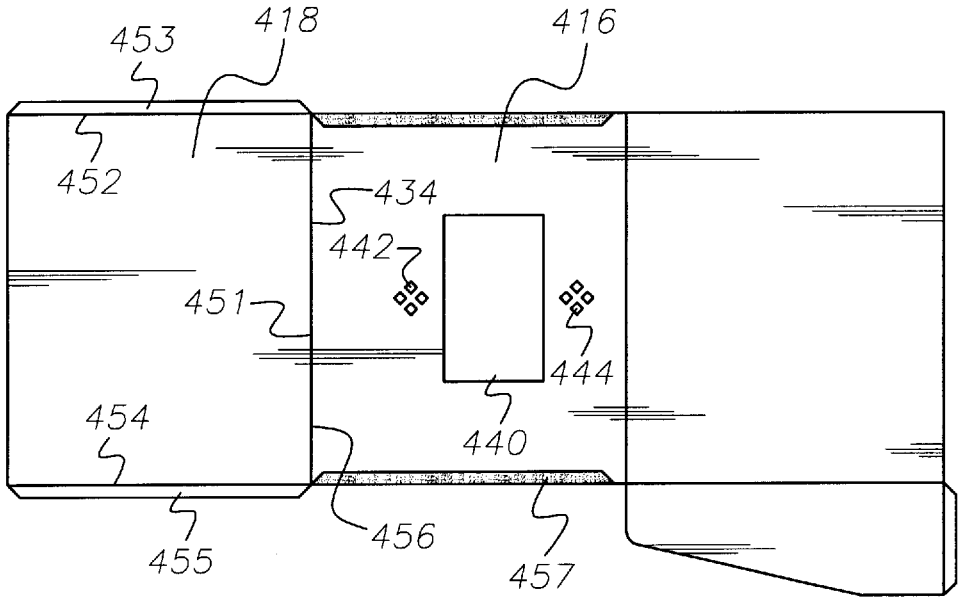
FIGS. 17A and B.
Figure 17B:
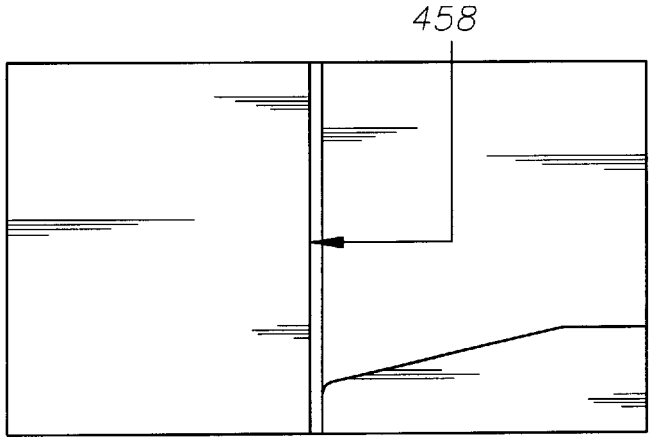
FIG. 17B is a plan view of a fifth preferred embodiment in open orientation.

As shown in FIG. 17A, front cover sheet 416 has large cutout window opening 440 and small design cutouts 442 and 444. Front cover sheet 416 also has lateral edge 434. Front cover backing sheet 418 has lateral edge 451. Front cover backing sheet 418 also has short upper edge 452 and short lower edge 454. Front cover backing sheet 418 can be formed separately from front cover sheet 416, but preferably is formed integrally with it. Specifically, lateral edge 451 of backing sheet 418 is formed integrally with lateral edge 434 to form a first common joining or vertical foldline 456. Front cover backing sheet 418 further has short top flap 453 extending upwardly from upper edge 452 and short bottom flap 455 extending downwardly from lower edge 454.

To form pocket 458 for placement of an insert sheet, top flap 453 is folded down and bottom flap 455 is folded up. Preferably, top flap 453 and bottom flap 455 have adhesive 457 that couples top flap 453 and bottom flap 455 to the inner face of front cover sheet 416 to form pocket 458 for the receipt of an insert sheet.

The remaining components, features and assembly of the fifth preferred embodiment are identical to the first preferred embodiment. Reference should be had to the description of the first preferred embodiment, as such description will not be repeated here.

DESCRIPTION OF A SIXTH PREFERRED EMBODIMENT

Figure 18:
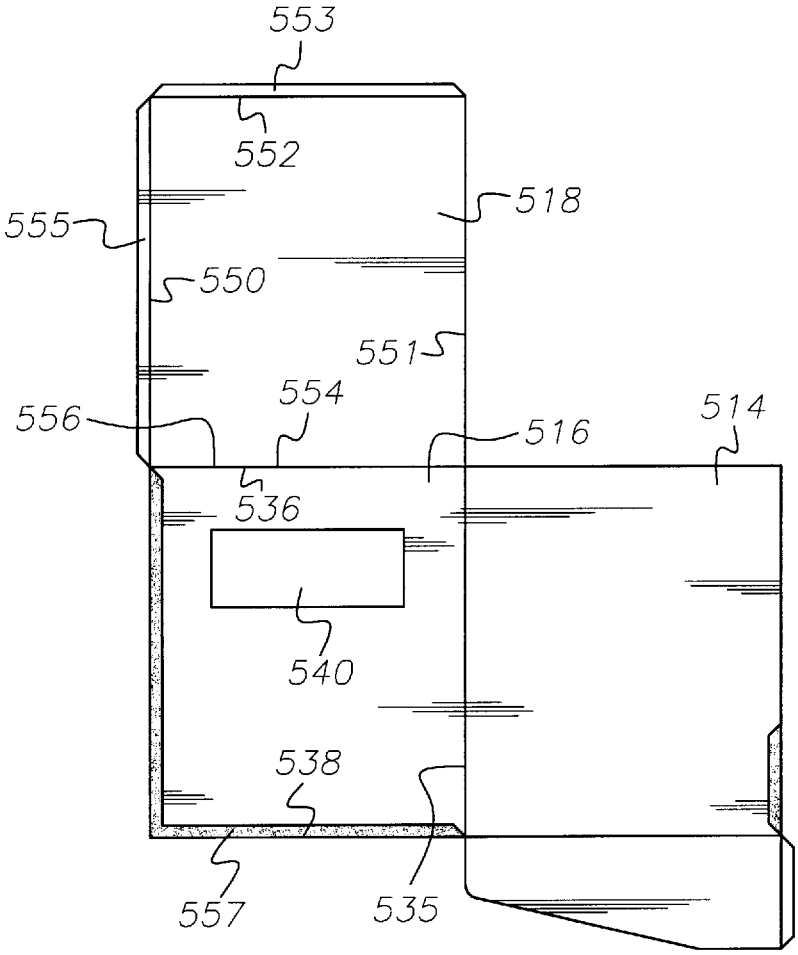
FIG. 18 is a plan view of a sixth preferred embodiment in spread orientation.

Referring to FIG. 18, the folio system of the sixth preferred embodiment includes a front cover backing sheet that is integrally attached to an upper edge of the front cover sheet. Otherwise, the sixth preferred embodiment is substantially the same as the first preferred embodiment.

Specifically, the folio system of the sixth preferred embodiment has a back cover 514, a front cover sheet 516, and a front cover backing sheet 518. Front cover sheet 516 has short upper edge 536 and short lower edge 538, while front cover backing sheet 518 has lateral edges 550 and 551. Front cover backing sheet 518 further has short upper edge 552 and short lower edge 554. Front cover backing sheet 518 is formed integrally with front cover sheet 516. Specifically, lower edge 554 is formed integrally with short upper edge 536 of front cover sheet 516 to define a common joining or horizontal foldline 556. Front cover backing sheet 518 further has short top flap 553 extending upwardly from upper edge 552 and short lateral flap 555 extending from lateral edge 550.

To form a pocket for placement of insert sheet(s), top flap 553 is folded down and lateral flap 555 is folded in. Preferably, top flap 553 and lateral flap 555 have adhesive 557 that couples top flap 553 and lateral flap 555 to the inner face of front cover sheet 516 to form a pocket with an opening at a lateral edge of front cover sheet 516 for the receipt of insert sheet(s).

The remaining components, features and assembly of the sixth preferred embodiment are identical to the first preferred embodiment. Reference should be had to the description of the first preferred embodiment, as such description will not be repeated here.

DESCRIPTION OF A SEVENTH PREFERRED EMBODIMENT

The folio system of the seventh preferred embodiment has both a front cover having a pocket for placement of insert sheet(s) and a front cover flap to secure the folio in a closed orientation. The front cover sheet also has a window cutout through which an insert sheet is visible. Further, the front cover flap has a cutout window corresponding to the cutout window of the front cover sheet such that the insert sheet remains visible when the front cover flap is folded over the front cover.

With reference now to the drawings, and in particular, to FIGS. 19A–D thereof, a seventh preferred embodiment of the new folio system embodying the principles and concepts of the present invention will be described.

Figure 19A:
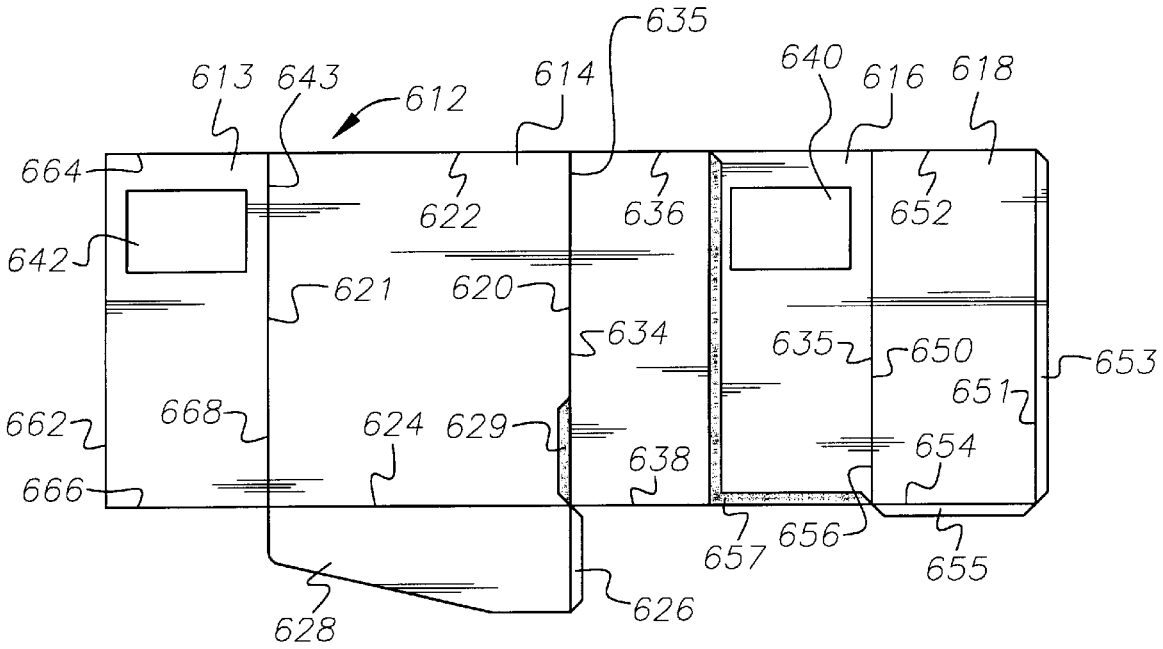
FIGS. 19A, B, C, and D.

More specifically, in the seventh preferred embodiment the present invention is a system, having a folio 612, as shown in FIG. 19A. The folio is preferably rectangular in configuration, and in the seventh preferred embodiment is formed of a first rear or back cover sheet 614, a second outer front cover sheet 616, a third front cover backing sheet 618, and a front cover flap 613. Back cover sheet 614 has long vertical side edges 620 and 621. In this preferred form it also has a short upper edge 622 and a short lower edge 624. Back cover sheet 614 may have a short bottom flap 628 that extends downwardly from bottom edge 624. Short bottom flap 628 may have one short laterally disposed flap 626. Short bottom flap 628 is adapted to be folded upwardly to cover a portion of the back cover sheet. Short lateral flap 626 is adapted to be folded under. Preferably there is adhesive 629 that couples together short lateral flap 626 and back cover sheet 614 to form a pouch pocket 630 in back cover sheet 614 for the receipt of supplemental material(s).

Next provided in this embodiment is the folio's second sheet, namely outer front cover sheet 616. Outer front cover sheet 616 is also preferably in a rectangular configuration. Outer front cover sheet 616 has two long vertical side edges, 634 and 635. Vertical long edge 634 of outer front cover sheet 616 is formed integrally with long vertical edge 620 of back cover sheet 614 of the folio along a first common joining or vertical fold line 635. Outer front cover sheet 616 further has a short upper edge 636 and a short lower edge 638. Outer front cover sheet 616 has at least one cutout opening therein, which in this embodiment is shown as a large rectangular window opening 640.

Figure 19B:
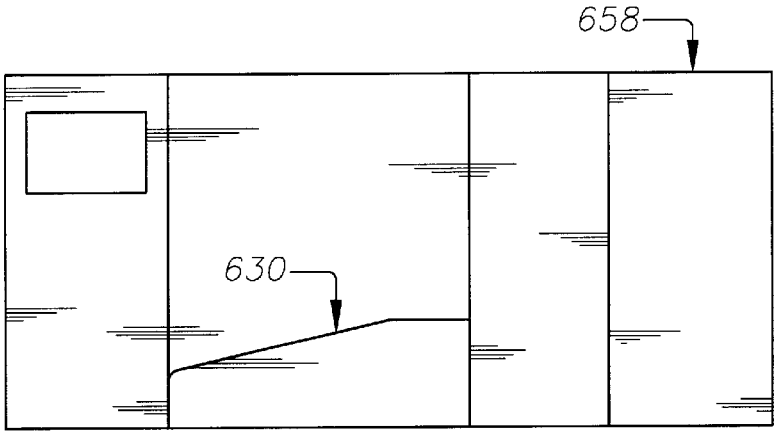
FIG. 19B is a plan view of a seventh preferred embodiment in an open orientation.
Figure 19C:
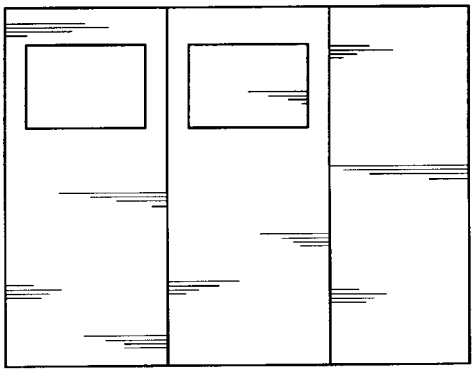
FIG. 19C is a plan view of a seventh preferred embodiment wherein the front cover flap remains open; and, FIG. 19D is a front view of a seventh preferred embodiment constructed in accordance with the principles of the present invention.
Figure 19D:
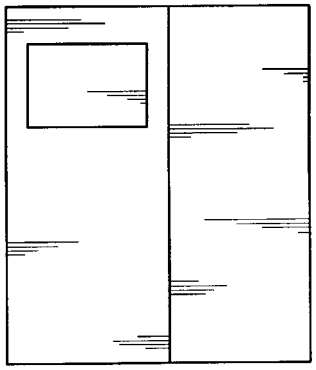

Next provided in this embodiment is the third folio sheet, namely the inner front cover backing sheet 618. Inner front cover backing sheet 618 is also preferably in a rectangular configuration. Inner front cover backing sheet may be formed separately from outer front cover 616, but in a preferred style, is formed integrally with it. Inner front cover backing sheet 618 has long side edges 650 and 651. It also has a short upper edge 652 and a short lower edge 654. Long edge 650 of inner front cover backing sheet 618 is preferably formed integrally with long vertical edge 635 of outer front cover sheet 616 at a second common joining or vertical fold line 656. Inner front cover backing sheet 618 may have a lateral flap 653 extending along vertical edge 651 and a bottom flap 655 extending downwardly from bottom edge 654. In this embodiment, lateral flap 653 is folded in, bottom flap 655 is folded up, and inner front backing sheet 618 is folded over and made to be in contact with outer front cover sheet 616. Preferably adhesive 657 couples lateral flap 653 and bottom flap 655 to front cover sheet 616 to thereby form a pocket 658 with an open upper edge between the outer front cover sheet and the front cover backing sheet. Pocket 658 is shown in FIG. 19B.

Next provided is front cover flap 613, which is also preferably in a rectangular configuration. Front cover flap 613 has two long vertical side edges, 662 and 668. Vertical long edge 668 of front cover flap 613 is formed integrally with long vertical edge 621 of back cover sheet 614 of the folio, along a third common joining or vertical fold line 643. Front cover flap 612 further has a short upper edge 664 and a short lower edge 666. Front cover flap 613 has at least one cutout opening therein, which in this embodiment is shown as a large rectangular window opening 642. Window opening 642 corresponds to window opening 640 in outer front cover sheet 616 such that the insert sheet remains visible through both window openings 640 and 642, when front cover flap 613 is folded over front cover sheet 616.

The insert sheet of the seventh preferred embodiment does not represent a change from previous embodiments. Accordingly, the insert sheet will not be discussed herein.

DESCRIPTION OF AN EIGHTH PREFERRED EMBODIMENT

An eighth preferred embodiment of the present invention provides a customizable folio system where in the front cover sheet has two separate pockets for the receipt of insert sheets or other materials, such as a brochure or a map. The double-pocket folio cover of this embodiment includes a front or outer cover 716 and two backing sheets 718*a* and 718*b* joined to outer cover 716 at opposite edges. As in the second preferred embodiment, the front cover is formed separately from the back cover. Accordingly, the front and back folio covers must be bound or otherwise suitably joined together.

Figure 20A:
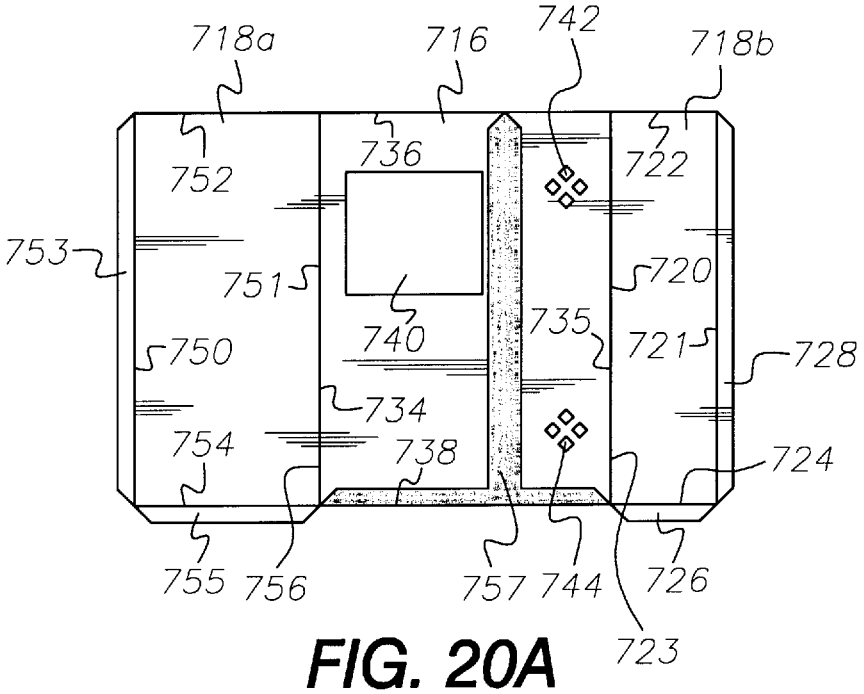
FIGS. 20A, B, and C.
Figure 20B:
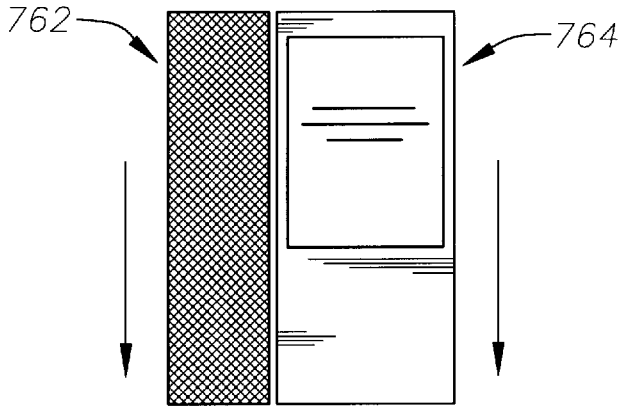
FIG. 20B is a front view of the two insert sheets of the eighth preferred embodiment; and, FIG. 20C is a front view of the folio cover of the eighth preferred embodiment constructed in accordance with the principles of the present invention.
Figure 20C:
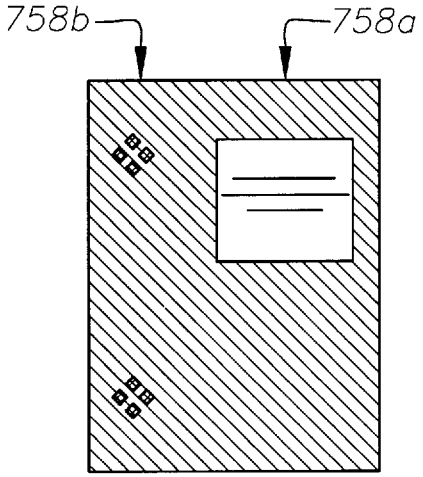

As shown in FIGS. 20A–20C, provided in this embodiment is the folio's separate outer front cover 716. Outer front cover 716 is preferably in a rectangular configuration, having long vertical side edges 734 and 735. It further has a short upper edge 736 and a short lower edge 738. Outer front cover 716 is formed with at least one cutout therein, which in this embodiment is shown as large rectangular window opening 740. Front cover sheet 716 further has an array of small cutout openings 742 and 744 located laterally to large rectangular window opening 740. Window opening 740 corresponds to pocket 758*a*, while small cutout openings 742 and 744 correspond to pocket 758*b*. See FIGS. 20A–20C.

Next provided is first and second inner front cover backing sheets 718*a* and 718*b*, which are also preferably in a rectangular configuration. First inner front cover backing sheet 718*a* may be formed separately from outer front cover 716, but in a preferred style, is formed integrally with it. Inner front cover backing sheet 718*a* has long side edges 750 and 751, a short upper edge 752 and a short lower edge 754. In preferred form, inner front backing sheet 718*a* has lateral flap 753 that extends laterally along the length of vertical edge 750. In addition there is a bottom flap 755 that extends downwardly from short lower edge 754. Lateral flap 753 is adapted to be folded inwardly and bottom flap 755 is adapted to be folded upwardly. Long edge 751 of the inner front cover backing sheet is preferably formed integrally with long vertical edge 734 of outer front cover sheet 716 to form a joining or vertical fold line 756. When the outer front cover sheet is formed integrally with the inner front backing sheet, the inner front backing sheet 718*a* is folded over and in contact with outer front cover sheet 716. Preferably, adhesive 757 couples lateral flap 753 and bottom flap 755 to the inner face of front cover sheet 716 to thereby form a pocket 758*a* with an open upper edge between the outer front cover sheet 716 and front cover backing sheet 718*a*. Pocket 758*a* is shown in FIG. 20C.

Next provided in this embodiment is second inner front cover backing sheet 718*b*. Inner front cover backing sheet 718*b* may be formed separately from outer front cover 716, but in a preferred style, is formed integrally with it. Inner front cover backing sheet 718*b* has long side edges 720 and 721, a short upper edge 722 and a short lower edge 724 In preferred form, inner front backing sheet 718*b* has lateral flap 728 that extends laterally along the length of vertical edge 721. In addition there is a bottom flap 726 that extends downwardly from short lower edge 724. Lateral flap 728 is adapted to be folded inwardly and bottom flap 726 is adapted to be folded upwardly. Long edge 720 of the inner front cover backing sheet is preferably formed integrally with long vertical edge 735 of outer front cover sheet 716 to form a joining or vertical fold line 723. When the outer front cover sheet is formed integrally with the inner front backing sheet, the inner front backing sheet 718*b* is folded over and in contact with outer front cover sheet 716. Preferably, adhesive 757 couples lateral flap 728 and bottom flap 726 to the inner face of front cover sheet 716 to thereby form a pocket 758*b* with an open upper edge between the outer front cover sheet 716 and front cover backing sheet 718*b*. Pocket 758*b* is shown in FIG. 20C.

Lastly, provided in the eighth preferred embodiment are a first insert sheet 762 and second insert sheet 764. First insert sheet 762 is sized to be positionable within pocket 758*b*. Similarly, second insert sheet 764 is sized to be positionable within pocket 758*a*. In use, the user may place a variety of materials in pockets 758*a* and 758*b*. By way of example, pocket 758*a* and pocket 758*b* may be sized such that the user may place a brochure in pocket 758*a* and an insert sheet in pocket 758*b* to create a customized folio cover. In this manner, pocket 758*b* holds material that creates a design element in the folio cover and pocket 758*a* holds material that provides information to the user should the user remove the brochure from the pocket.

The remaining components, construction and assembly of the eighth preferred embodiment are substantially identical to the second preferred embodiment. Therefore, reference should be had to the discussion of the second preferred embodiment as such disclosure will not be repeated here.

DESCRIPTION OF A NINTH PREFERRED EMBODIMENT

Figure 21A:
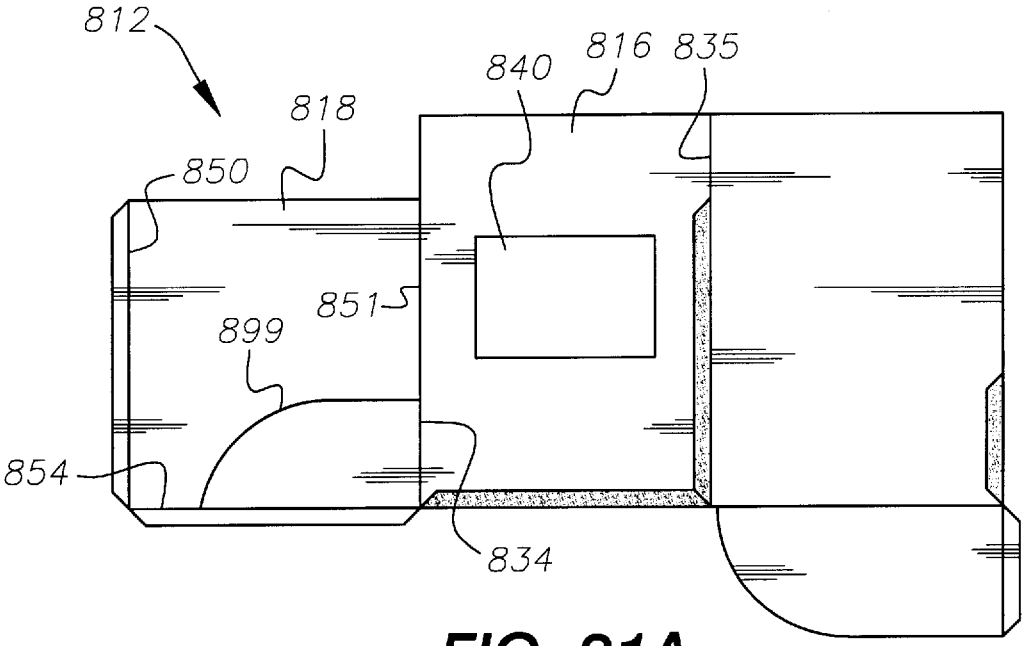
FIGS. 21A and B.
Figure 21B:
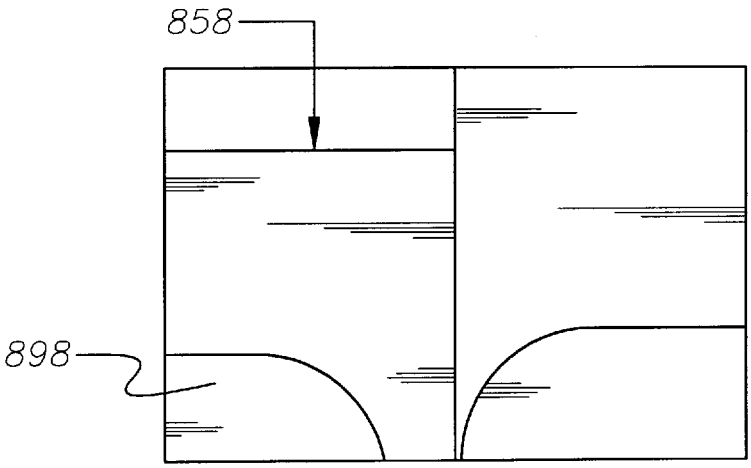
FIG. 21B is a plan view of the folio of the ninth preferred embodiment, in open orientation, showing the smaller pocket between the folio's outer cover and its inner backing sheet.

As illustrated in FIGS. 21A and B, a ninth preferred embodiment provides a customizable folio system 812 wherein the vertical edges 850 and 851 of the inner backing sheet 818 are shorter than the vertical edges 834 and 835 of the front cover sheet 816. This configuration effects a smaller pocket 858 facilitating placement or removal of an insert sheet or other materials, such as a brochure. (Preferably, in other embodiments not shown, smaller pocket 858 will be formed of a backing sheet having vertical edges that are at least about one half the length of the vertical edges of the front cover.) Otherwise, the ninth preferred embodiment is substantially identical to the first preferred embodiment in components, construction, and assembly.

By way of example, the smaller pocket 858 could hold a brochure, part of which will be visible through cutout section 840 in front cover sheet 816. Further, if the length of the brochure exceeds the vertical edges 850 and 851 of the backing sheet 818, the user will have easier access to the brochure, when the folio 812 is opened.

Furthermore, front cover backing sheet 818 may include a slit 899 that defines a flap 898 for the receipt of supplemental materials. The bottom edge of the inserted supplemental materials rests against lower edge 854 and between flap 898 and front cover sheet 816.

SUMMARY

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described. Accordingly, all suitable modifications and equivalents which may be resorted to fall within the scope of the invention.

What is claimed is:

1. A customizable cover system for a folio or report comprising an outer cover sheet adapted to be attached to a second cover to form a folio, at least one inner backing sheet, and at least one user customizable insert sheet capable of being imprinted upon by a laser or ink jet printer;

wherein at least one inner backing sheet is affixed to said outer cover sheet so as to form at least one pocket between said outer cover sheet and said inner backing sheet;

wherein there is at least one cutout window section in the area of a pocket, where the cutout window section(s) is in a sheet selected from the group consisting of (1) said outer cover sheet, and (2) said inner backing sheet;

wherein said insert sheet is positionable within a pocket between the outer cover sheet and said inner backing sheet;

and further wherein said insert sheet has at least one area of color and/or texture, wherein said area(s) has no pre-applied indicia thereon except said color and/or texture, and further wherein said area(s) is approximately co-extensive with said cutout window section(s) and is visible through said cutout window section(s) when said insert sheet is placed in said pocket.

2. A cover system of claim 1 wherein said inner backing sheet is substantially the same size as the outer cover sheet.

3. A cover system of claim 1 wherein said inner backing sheet has at least one vertical edge that is substantially the same length as at least one vertical edge of the outer cover sheet.

4. A cover system of claim 1 wherein said inner backing sheet has at least one vertical edge that is at least one half the length of at least one vertical edge of the outer cover sheet.

5. A cover system of claim 1 wherein said backing sheet is affixed to the outer cover sheet so as to form a pocket with an open upper edge between the outer cover sheet and said inner backing sheet.

6. A cover system of claim 1 wherein said backing sheet is affixed to the outer cover sheet so as to form a pocket with an open lateral edge between the outer cover sheet and said inner backing sheet.

7. A cover system of claim 1 wherein said insert sheet includes means for securing at least one of the following thereto: business card(s), photograph(s), textual material(s), pictorial material(s), and graphic material(s).

8. The cover system of claim 7 wherein said attachment means correspond to said cutout window sections such that material attached thereby is visible through said cutout window sections.

9. A cover system of claim 1 wherein said insert sheet has adhesive means for securing said insert sheet in said pocket between said outer cover sheet and said inner backing sheet.

10. A cover system according to claim 1 further comprising a second folio cover attached to said outer cover sheet.

11. A cover system according to claim 10 wherein said second folio cover is a back folio cover.

12. A cover system according to claim 10 wherein said second folio cover has at least one pouch pocket therein.

13. A cover system according to claim 12 wherein said pouch pocket includes means for securing supplemental material(s) thereto.

14. A cover system of claim 11 wherein said second folio cover includes a cover flap affixed to an edge of said second folio cover such that said flap folds over to partially cover and thereby secure said first folio cover.

15. A cover system of claim 14 wherein said cover flap has cutout section(s) corresponding to at least one cutout section in said outer cover such that said insert sheet remains visible through said cutout section(s) when said cover flap is folded over said outer cover.

16. A cover system according to claim 1 wherein inner backing sheet includes means for securing supplemental material(s) thereto.

17. A cover system of claim 1 wherein said inner backing sheet includes at least one pouch pocket for the receipt of supplemental material(s).

18. A folio system comprising at least one insert sheet and a folio formed of a first sheet, a second sheet and a third sheet; the first sheet being formed integrally with the second sheet, the second sheet having at least one cutout window section therethrough with one edge of the second sheet being formed integrally with one edge of the first sheet along a common first vertical fold line; the third sheet being formed integrally with one edge of the second sheet remote from the first sheet to form a common second vertical fold line, the third sheet being folded over and in contact with the second sheet and coupled thereto along an edge of the third sheet remote from the second sheet and along a lower edge thereof to thereby form a pocket with an open upper edge between the second and third sheets; and at least one user customizable insert sheet capable of being imprinted upon by a laser or ink jet printer and selectively positionable within said pocket wherein said insert sheet has at least one area of color and/or texture, wherein said area(s) has no pre-applied indicia thereon except said color and/or texture, and further wherein said area(s) is approximately co-extensive with said cutout window section(s) and is visible through said cutout window section(s) when said insert sheet is placed in said pocket.

19. A folio system of claim 18 wherein the second sheet further has at least one set of cutout openings wherein the cutout openings form a design element in the outer face of the second sheet.

20. A folio system of claim 18 wherein the first sheet has one bottom flap extending downwardly from the bottom edge and one short laterally disposed flap extending laterally from one vertical edge of the bottom flap, the short laterally disposed flap adapted to be folded over to cover a portion of the bottom flap and the bottom flap adapted to be folded upwardly to cover a portion of the first sheet with adhesive coupling together the short laterally disposed flap and the first sheet to form a pouch pocket for the receipt of supplemental material(s).

21. A folio system of claim 18 wherein the second sheet is formed with a plurality of openings therethrough and said insert sheet includes preprinted color for being viewed through the plurality of openings in the second sheet.

22. A folio system of claim 18 wherein said insert sheet has adhesive means for securing said insert sheet in said pocket between the second and third sheets.

23. A folio system of claim 18 wherein said insert sheet includes means for securing supplemental material(s) thereto wherein the supplemental material(s) are selected from the group consisting of business card(s), photograph (s), textual material(s), pictorial material(s), and graphic material(s).

24. A folio system of claim 23 wherein the regions of said insert sheet having materials attached thereto are viewable through the openings in said second sheet.

25. A folio system of claim 18 wherein the folio and said insert sheet are essentially rectangular in configuration.

26. A folio system of claim 18 wherein the folio and the insert sheet are essentially square in configuration.

27. A folio system for presenting user-customized optical characteristics to a front face of a folio through selective replacement of user customizable insert sheet(s) comprising, in combination: a folio formed of a first rear sheet, a second front sheet and a third backing sheet; the first rear sheet being in a rectangular configuration and having long vertical side edges and a short upper edge and a short lower edge; the second front sheet being in a rectangular configuration having long vertical side edges and a short upper edge and a short lower edge, the second front sheet being formed with at least one large window-like cutout section and at least one additional smaller upper cutout opening therein above said large window-like cutout section and at least one additional lower smaller cutout opening below said large window-like cutout section, one vertical long edge of the second front sheet being formed integrally with one long vertical edge of the first rear sheet along a primary vertical fold line; the third backing sheet being in a rectangular configuration having long vertical side edges and a short upper edge and a short lower edge, one long edge of the third backing sheet being formed integrally with the long vertical edge of the second front sheet remote from the first rear sheet to form a secondary vertical fold line, the third backing sheet being folded over in contact with the second front sheet and secured with adhesive along the vertical edge of the third backing sheet adjacent to the second front sheet and along the lower edge thereof to thereby form a pocket with an open upper edge between the second front sheet and the third backing sheet; and at least one user customizable insert sheet capable of being imprinted upon by a laser or ink jet printer and selectively positionable within the pocket, the insert sheet having an upper area of color and/or texture, wherein said upper area has no pre-applied indicia thereon except said color and/or texture, and further wherein said upper area is approximately co-extensive with and positionable behind the smaller upper opening(s) and a lower area of color and/or texture, wherein said lower area has no pre-applied indicia thereon except said color and/or texture, and further wherein said lower area is approximately co-extensive with and positionable behind the smaller lower opening(s) and a central region positionable behind the large window-like opening, wherein said central region has an area of color and/or texture, wherein said area has no pre-applied indicia thereon except said color and/or texture, and further wherein said area is approximately co-extensive with said large window-like cutout section, said areas of color and/or texture on the insert sheet positioned for being viewed through the openings and said cutout section.

28. A folio system of claim 27 wherein the upper area on the insert sheet is a first color, and the lower area is a second color.

29. A first cover system comprising: an outer cover sheet adapted to be attached to a second cover to form a folio, at least one backing sheet, and at least one user customizable insert sheet capable of being imprinted upon by a laser or ink jet printer, wherein said backing sheet has at least one cutout window section therein, wherein said backing sheet is affixed to said outer cover sheet so as to form at least one pocket between said outer cover sheet and said backing sheet, wherein said backing sheet has at least one vertical edge that is at least one half the length of at least one vertical edge of the outer cover sheet, wherein said insert sheet(s) is positionable within said pocket between said outer cover sheet and said backing sheet, and further wherein said insert sheet(s) has at least one area of color and/or texture, wherein said area(s) has no pre-applied indicia thereon except said color and/or texture, and further wherein said area(s) is approximately co-extensive with said cutout window section (s) and is visible through said cutout window section(s) when said insert sheet is placed in said pocket.

30. A first cover system comprising an outer cover sheet, at least two backing sheets and at least one user customizable insert sheet capable of being imprinted upon by a laser or ink jet printer, wherein the backing sheets are affixed to the outer cover sheet so as to form at least two pockets between the outer cover sheet and the backing sheets into which insert sheet(s) can be placed, wherein the outer cover sheet has at least one cutout window section therein, and further wherein said insert sheet(s) has at least one area of color and/or texture, wherein said area(s) has no pre-applied indicia thereon except said color and/or texture, and further wherein said area(s) is approximately co-extensive with said cutout window section(s) and is visible through said cutout window section(s) when said insert sheet is placed in said pocket.

31. A folio comprising an outer cover sheet, at least two backing sheets and at least one user customizable insert sheet capable of being imprinted upon by a laser or ink jet printer, wherein the backing sheets are affixed to the outer cover sheet so as to form at least two pockets between the outer cover sheet and the backing sheets into which insert sheet(s) can be placed, wherein at least one of the backing sheets has at least one cutout window section therein, and further wherein said insert sheet(s) has at least one area of color and/or texture, wherein said area(s) has no pre-applied indicia thereon except said color and/or texture, and further wherein said area(s) is approximately co-extensive with said cutout window section(s) and is visible through said cutout window section(s) when said insert sheet is placed in said pocket.

32. A folio system comprising at least one user customizable insert sheet and a folio formed of a first sheet, a second sheet and a third sheet; the first sheet being formed integrally with the second sheet, the second sheet having at least one cutout window section therethrough with one edge of the second sheet being formed integrally with one edge of the first sheet along a common first vertical fold line; the third sheet being formed integrally with one edge of the second sheet remote from the first sheet to form a common second vertical fold line, the third sheet being folded over and in contact with the second sheet and coupled thereto along an edge of the third sheet remote from the second sheet and along a lower edge and an upper edge thereof to thereby form a pocket with an open lateral edge between said second and third sheets; wherein said insert sheet is capable of being imprinted upon by a laser or ink jet printer and is selectively positionable within said pocket, and further wherein said insert has at least one area of color and/or texture, wherein said area(s) has no pre-applied indicia thereon except said color and/or texture, and further wherein said area(s) is approximately co-extensive with said cutout window section (s).

33. A folio system comprising at least one user customizable insert sheet and a folio formed of a first sheet, a second sheet and a third sheet; wherein the first sheet is attached to said second sheet; the second sheet having at least one cutout window section therethrough; the third sheet being formed integrally with one edge of the second sheet to form a common vertical fold line, the third sheet being folded over and in contact with the second sheet and coupled thereto along an edge of the third sheet remote from the second sheet and along a lower edge and an upper edge thereof to thereby form a pocket with an open lateral edge between said second and third sheets; wherein said user customizable insert sheet is capable of being imprinted upon by a laser or ink jet printer, and wherein said insert sheet is selectively positionable within said pocket, wherein said insert sheet has at least one area of color and/or texture, and wherein said area(s) has no pre-applied indicia thereon except said color and/or texture, and further wherein said area(s) is approximately co-extensive with said cutout window section(s) and is visible through said cutout window section(s) when said insert sheet is placed in said pocket.

34. A folio system comprising at least one user customizable insert sheet and a folio formed of a first sheet, a second sheet and a third sheet; the first sheet being formed integrally with the second sheet, the second sheet having at least one cutout window section therethrough with one edge of the second sheet being formed integrally with one edge of the first sheet along a common first vertical fold line; the third sheet being formed integrally with the top edge of the second sheet to form a common horizontal fold line, the third sheet being folded over and in contact with the second sheet and coupled thereto along an edge of the third sheet remote from the second sheet and along a lateral edge thereof to thereby form a pocket with an open lateral edge between the second and third sheets; wherein said user customizable insert sheet is capable of being imprinted upon by a laser or ink jet printer, and wherein said insert sheet is selectively positionable within said pocket, and further wherein said insert sheet has at least one area of color and/or texture, and still further wherein said area(s) has no pre-applied indicia thereon except said color and/or texture, and further wherein said area(s) is approximately co-extensive with said cutout window section(s) and is visible through said cutout window section(s) when said insert sheet is placed in said pocket.

35. A customizable cover system for a folio or report comprising, in combination, an outer cover sheet adapted to be attached to a second cover to form a folio, at least one inner backing sheet, and at least one user customizable insert sheet capable of being imprinted upon by a laser or ink jet printer;

wherein said inner backing sheet is affixed to said outer cover sheet so as to form at least one pocket between said outer cover sheet and said inner backing sheet;

wherein there is at least one cutout window section in the area of said pocket, where said cutout window section (s) is in a sheet selected from the group consisting of (1) said outer cover sheet, and (2) said inner backing sheet;

wherein said insert sheet is positionable within said pocket between said outer cover sheet and said inner backing sheet;

wherein said user customizable insert sheet is colored and/or textured, or includes color and/or texture, and has no pre-applied indicia thereon except said color and/or texture, at least in any area of the insert sheet that will be visible through said cutout(s) when said insert sheet is placed in said pocket, wherein at least one area(s) of color and/or texture on said user customizable insert sheet is capable of being imprinted upon by a laser or ink jet printer to include text and/or graphics and/or color of the user's choice, and finally wherein said imprintable area(s) of color and/or texture is visible through at least one of said cutout window section(s) when said insert sheet is placed in said pocket.

36. A cover system of claim 35 wherein said inner backing sheet is substantially the same size as the outer cover sheet.

37. A cover system of claim 35 wherein said inner backing sheet has at least one vertical edge that is substantially the same length as at least one vertical edge of the outer cover sheet.

38. A cover system of claim 35 wherein said inner backing sheet has at least one vertical edge that is at least one half the length of at least one vertical edge of the outer cover sheet.

39. A cover system of claim 35 wherein said backing sheet is affixed to the outer cover sheet so as to form a pocket with an open upper edge between the outer cover sheet and said inner backing sheet.

40. A cover system of claim 35 wherein said backing sheet is affixed to the outer cover sheet so as to form a pocket with an open lateral edge between the outer cover sheet and said inner backing sheet.

41. A cover system according to claim 35 further comprising a second folio cover attached to said outer cover sheet.

42. A cover system according to claim 41 wherein said second folio cover is a back folio cover.

43. A cover system according to claim 42 wherein said second folio cover has at least one pouch pocket therein.

44. A cover system of claim 41 wherein said second folio cover includes a cover flap affixed to an edge of said second folio cover such that said flap folds over to partially cover and thereby secure said first folio cover.

45. A cover system of claim 44 wherein said cover flap has cutout section(s) corresponding to at least one cutout section in said outer cover such that said insert sheet remains visible through said cutout section(s) when said cover flap is folded over said outer cover.

46. A user customizable folio system comprising, in combination, at least one customizable insert sheet capable of being imprinted upon by a laser or ink jet printer and a folio formed of a first rear sheet, a second front sheet and a third backing sheet; the first rear sheet being formed integrally with the second front sheet, the second front sheet having at least one cutout window section therethrough with one edge of the second front sheet being formed integrally with one edge of the first rear sheet along a common first vertical fold line; the third backing sheet being formed integrally with one edge of the second front sheet remote from the first rear sheet to form a common second vertical fold line, the third backing sheet being folded over and in contact with the second front sheet and coupled thereto along an edge of the third backing sheet remote from the second front sheet and along a lower edge thereof to thereby form a pocket with an open upper edge between the second front and third backing sheets; wherein said user customizable insert sheet is selectively positionable within said pocket, wherein said customizable insert sheet is colored and/or textured, or includes color and/or texture, and has no pre-applied indicia thereon except said color and/or texture, at least in any area of the insert sheet that will be visible through said cutout(s) when said insert sheet is placed in said pocket, wherein at least one area(s) of color and/or texture on said user customizable insert sheet is capable of being imprinted upon by a laser or ink jet printer to include text and/or graphics and/or color of the user's choice, and finally wherein said imprintable area(s) of color and/or texture is visible through at least one of said cutout window section(s) when said insert sheet is placed in said pocket.

47. A folio system according to claim 46 wherein said third backing sheet is folded over said second front sheet and coupled to said second front sheet along a lower edge and an upper edge thereof to thereby form a pocket with an open lateral edge between said second front and third backing sheets.

48. A folio system of claim 46 wherein the first rear sheet has one bottom flap extending downwardly from the bottom edge and one short laterally disposed flap extending laterally from one vertical edge of the bottom flap, the short laterally disposed flap adapted to be folded over to cover a portion of the bottom flap and the bottom flap adapted to be folded upwardly to cover a portion of the first rear sheet with adhesive coupling together the short laterally disposed flap and the first sheet to form a pouch pocket for the receipt of supplemental material(s).

49. A folio system of claim 46 wherein the second front sheet is formed with a plurality of openings therethrough and said insert sheet includes color or texture for being viewed through the plurality of openings in the second front sheet.

50. A folio system of claim 46 wherein the third backing sheet is formed integrally with the top edge of the second front sheet to form a common horizontal fold line, the third backing sheet being folded over and in contact with the second front sheet and coupled thereto along an edge of the third backing sheet remote from the second front sheet and along a lateral edge thereof to thereby form a pocket with an open lateral edge between the second front and third backing sheets.

51. A customizable first cover system comprising, in combination: an outer cover sheet adapted to be attached to a second cover to form a folio, at least one inner backing sheet, and at least one insert sheet capable of being imprinted upon by a laser or ink jet printer to include text and/or graphics and/or color of user's choice, wherein said inner backing sheet has at least one cutout window section therein, wherein said inner backing sheet is affixed to said outer cover sheet so as to form at least one pocket between said outer cover sheet and said inner backing sheet, wherein said inner backing sheet has at least one vertical edge that is at least one half the length of at least one vertical edge of the outer cover sheet, and wherein said user customizable insert sheet(s) is positionable within said pocket between said outer cover sheet and said inner backing sheet, and further wherein said user customizable insert sheet(s) is colored and/or textured, or includes color and/or texture, and has no pre-applied indicia thereon except said color and/or texture, at least in any area that will be visible through said cutout(s) when said insert sheet is placed in said pocket, wherein at least one area(s) of color and/or texture on said customizable insert sheet is capable of being imprinted on with a laser or ink jet printer to include text, and/or graphics, and/or color of user's choice, and finally wherein said imprintable area(s) of color and/or texture is visible through at least one of said cutout window section(s) when said insert sheet is placed in said pocket.

52. A customizable first cover system comprising an outer cover sheet, at least two backing sheets and at least one user customizable insert sheet capable of being imprinted upon by a user with a laser or ink jet printer to include text and/or graphics and/or color of user's choice, wherein the backing sheets are affixed to the outer cover sheet so as to form at least two pockets between the outer cover sheet and the backing sheets into which the insert sheet(s) can be placed, wherein the outer cover sheet has at least one cutout window section therein, and further wherein the insert sheet(s) is colored and/or textured, or includes color and/or texture, and has no pre-applied indicia thereon, except said color and/or texture, at least in any area of the insert sheet that will be visible through said cutout(s) when said insert sheet is placed in said pocket, and finally wherein said imprintable area(s) of color and/or texture is visible through at least one of said cutout window section(s) when said insert sheet is placed in said pocket.

53. A customizable first cover system comprising an outer cover sheet, at least two backing sheets and at least one user customizable insert sheet capable of being imprinted upon by a user with a laser or ink jet printer to include text and/or graphics and/or color of user's choice, wherein the backing sheets are affixed to the outer cover sheet so as to form at least two pockets between the outer cover sheet and the backing sheets into which the insert sheet(s) can be placed, wherein at least one backing sheet has at least one cutout window section therein, and further wherein the insert sheet(s) is colored and/or textured, or includes color and/or texture, and has no pre-applied indicia thereon, except said color and/or texture, at least in any area of the insert sheet that will be visible through said cutout(s) when said insert sheet is placed in said pocket, and finally wherein said imprintable area(s) of color and/or texture is visible through at least one of said cutout window section(s) when said insert sheet is placed in said pocket.

54. A customizable folio system comprising, in combination, at least one insert sheet and a folio formed of a first sheet a second sheet and a third sheet; the first sheet being formed integrally with the second sheet, the second sheet having at least one cutout window section therethrough with one edge of the second sheet being formed integrally with one edge of the first sheet along a common first vertical told line; the third sheet being formed integrally with one edge of the second sheet remote from the first sheet to form a common second vertical fold line, the third sheet being folded over and in contact with the second sheet and coupled thereto along an edge of the third sheet remote from the second sheet and along a lower edge and an upper edge thereof to thereby form a pocket with an open lateral edge between said second and third sheets; wherein said user customizable insert sheet is selectively positionable within said pocket and wherein said user customizable insert sheet is colored and/or textured, or includes color and/or texture, and has no pre-applied indicia thereon, except said color and/or texture, at least in any area of the insert sheet that will be visible through said cutout(s) when said insert sheet is placed in said pocket, wherein at least one area(s) of color and/or texture on said user customizable insert sheet is capable of being imprinted upon by a laser or ink jet printer to include text and/or graphics and/or color of the user's choice, and finally wherein said imprintable area(s) of color and/or texture is visible through at least one of said cutout window section(s) when said insert sheet(s) is placed in said pocket.

55. A customizable folio system comprising, in combination, at least one insert sheet and a folio formed of a first sheet, a second sheet and a third sheet; wherein the first sheet is attached to said second sheet; the second sheet having at least one cutout window section therethrough; the third sheet being formed integrally with one edge of the second sheet to form a common vertical fold line, the third sheet being folded over and in contact with the second sheet and coupled thereto along an edge of the third sheet remote from the second sheet and along a lower edge and an upper edge thereof to thereby form a pocket with an open lateral edge between said second and third sheets; wherein said insert sheet is selectively positionable within said pocket, wherein said insert sheet is colored and/or textured, or includes color and/or texture, and has no pre-applied indicia thereon, except said color and/or texture, at least in any area of the insert sheet that will be visible through said cutout(s) when said insert sheet is placed in said pocket, wherein at least one area(s) of color and/or texture on said insert sheet is capable of being imprinted upon by a laser or ink jet printer to include text and/or graphics and/or color of the user's choice, and finally wherein said imprintable area(s) is visible through at least one of said cutout window section(s) when said insert sheet(s) is placed in said pocket.

56. A customizable folio system comprising, in combination, at least one insert sheet and a folio formed of a first sheet, a second sheet and a third sheet; the first sheet being formed integrally with the second sheet, the second sheet having at least one cutout window section therethrough with one edge of the second sheet being formed integrally with one edge of the first sheet along a common first vertical fold line; the third sheet being formed integrally with the top edge of the second sheet to form a common horizontal fold line, the third sheet being folded over and in contact with the second sheet and coupled thereto along an edge of the third sheet remote from the second sheet and along a lateral edge thereof to thereby form a pocket with an open lateral edge between the second and third sheets; wherein said insert sheet is selectively positionable within said pocket, wherein said insert sheet is colored and/or textured, or includes color and/or texture, and has no pre-applied indicia thereon, except said color and/or texture, at least in any area of the insert sheet that will be visible through said cutout(s) when said insert sheet is placed in said pocket, and finally wherein said imprintable area(s) of color and/or texture is visible through at least one of said cutout window section(s) when said insert sheet(s) is placed in said pocket.

57. A method of using a cover system for a folio or report that is customizable, by means of a laser or ink jet printer, to include text and/or graphics and/or color of the user's choice, comprising, obtaining an outer cover sheet attached to, or adapted to be attached to a second cover to form a folio, wherein at least one inner backing sheet is affixed to said outer cover sheet so as to form at least one pocket between said outer cover sheet and said inner backing sheet, and further wherein there is at least one cutout window section in the area of a pocket, where said cutout window section(s) is in a sheet selected from the group consisting of (1) said outer cover sheet, and (2) said inner backing sheet;

obtaining an unbound user customizable insert sheet that is colored and/or textured, or includes at least one area of color and/or texture capable of being imprinted upon by a laser or ink jet printer, wherein said area(s) has no pre-applied indicia thereon except said color and/or texture;

imprinting on said user customizable insert sheet, with a laser or ink jet printer, text and/or graphics and/or color of user's choice, in at least one area of said user customizable insert sheet that will be visible through at least one cutout window section in said outer cover sheet or said inner backing sheet when said user customizable insert sheet is placed in said pocket between said outer cover sheet and said inner backing sheet;

placing said user imprinted unbound insert sheet into said pocket between said outer cover sheet and said inner backing sheet to create a folio that has been customized by the user.

* * * * *

UNITED STATES PATENT AND TRADEMARK OFFICE

CERTIFICATE OF CORRECTION

PATENT NO. : 5,890,774

DATED : April 6, 1999

INVENTOR(S) : Douglas G. Schwartz, Larry Leibe Mogelonsky, Daniel Solomon Schwartz It is certified that error appears in the above-indentified patent and that said Letters Patent is hereby corrected as shown below:

At Column 16, line 64, please delete "A cover system of claim 11" and insert -- A cover system of claim 10 -- thereof.

At Column 17, line 6, please insert -- said -- after "according to claim 1 wherein".

At Column 20, line 28, please insert -- still -- before "further wherein".

Signed and Sealed this

Tenth Day of August, 1999

*Attest:*

*Attesting Officer*

Q. TODD DICKINSON

*Acting Commissioner of Patents and Trademarks*